US009908648B2

(12) United States Patent
Lancaster, III et al.

(10) Patent No.: US 9,908,648 B2
(45) Date of Patent: Mar. 6, 2018

(54) DEMAND BASED WRAPPING

(75) Inventors: Patrick R. Lancaster, III, Louisville, KY (US); Michael Mitchell, Louisville, KY (US); Thomas Harris, Louisville, KY (US); Robert D. Janes, Sr., Louisville, KY (US); Richard L. Johnson, La Grange, KY (US)

(73) Assignee: Lantech.com, LLC, Louisville, KY (US)

( * ) Notice: Subject to any disclaimer, the term of this patent is extended or adjusted under 35 U.S.C. 154(b) by 1124 days.

(21) Appl. No.: 12/941,047

(22) Filed: Nov. 6, 2010

(65) Prior Publication Data

US 2011/0131927 A1 Jun. 9, 2011

Related U.S. Application Data

(63) Continuation-in-part of application No. 12/349,929, filed on Jan. 7, 2009, now Pat. No. 9,725,195.

(60) Provisional application No. 61/006,338, filed on Jan. 7, 2008, provisional application No. 61/258,740, filed on Nov. 6, 2009.

(51) Int. Cl.

| | |
|---|---|
| ***B65B 11/02*** | (2006.01) |
| ***B65B 11/04*** | (2006.01) |
| ***B65B 57/00*** | (2006.01) |
| *B65B 11/00* | (2006.01) |

(52) U.S. Cl.

CPC ..... *B65B 11/025* (2013.01); *B65B 11/045* (2013.01); *B65B 57/00* (2013.01); *B65B 2011/002* (2013.01); *B65B 2210/18* (2013.01); *B65B 2210/20* (2013.01)

(58) Field of Classification Search

CPC ..... B65B 11/025; B65B 11/045; B65B 2011/002; B65B 2210/18; B65B 2210/20

USPC ..... 53/399, 443, 461, 465, 52, 55, 504, 509, 53/64, 66, 118, 580, 582, 587, 588, 589, 53/591, 203, 211

See application file for complete search history.

(56) References Cited

U.S. PATENT DOCUMENTS

| | | | |
|---|---|---|---|
| 2,227,398 | A | 12/1940 | Mohl |
| 2,904,196 | A | 9/1959 | Teixeira |
| 3,029,571 | A | 4/1962 | Douthit |

(Continued)

FOREIGN PATENT DOCUMENTS

| | | | |
|---|---|---|---|
| DE | 3140972 | A1 | 6/1982 |
| DE | 3119038 | A1 | 12/1982 |

(Continued)

OTHER PUBLICATIONS

European Patent Office; Search Report and Written Opinion in International Patent Application No. PCT/US2010/055754 dated May 6, 2011; 16 pages.

(Continued)

*Primary Examiner* — Christopher Harmon
(74) *Attorney, Agent, or Firm* — Middleton Reutlinger

(57) ABSTRACT

A control system for a wrapping apparatus may include a packaging material dispenser configured to dispense packaging material for wrapping a load. The control system may also include at least one sensor assembly configured to generate a signal based on instantaneous demand for packaging material at the load. The control system may further include a controller configured to control operation of the packaging material dispenser based at least in part on the signal.

25 Claims, 9 Drawing Sheets

(56) References Cited

U.S. PATENT DOCUMENTS 3,815,313 A 6/1974 Heisler
3,910,005 A 10/1975 Thimon et al.
4,152,879 A 5/1979 Shulman
4,216,640 A 8/1980 Kaufman
4,235,062 A 11/1980 Lancaster, III et al.
4,271,657 A 6/1981 Lancaster, III et al.
4,300,326 A 11/1981 Stackhouse
4,387,548 A 6/1983 Lancaster et al.
4,395,255 A 7/1983 Branecky et al.
4,418,510 A 12/1983 Lancaster, III et al.
4,429,514 A 2/1984 Lancaster et al.
4,432,185 A 2/1984 Geisinger
4,458,467 A 7/1984 Shulman et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,590,746 A 5/1986 Humphrey
4,628,667 A 12/1986 Humphrey et al.
4,676,048 A 6/1987 Lancaster et al.
4,693,049 A 9/1987 Humphrey
4,712,354 A 12/1987 Lancaster et al.
4,716,709 A 1/1988 Lamb et al.
4,736,567 A 4/1988 Pienta
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,855,924 A 8/1989 Strosser
4,862,678 A 9/1989 Humphrey
4,866,909 A 9/1989 Lancaster, III et al.
4,905,451 A 3/1990 Jaconelli et al.
4,953,336 A 9/1990 Lancaster, III et al.
4,991,381 A 2/1991 Simons
5,027,579 A 7/1991 Keip
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,216,871 A 6/1993 Hannen
5,240,198 A 8/1993 Dorfel
5,301,493 A 4/1994 Chen
5,311,725 A 5/1994 Martin et al.
5,315,809 A * 5/1994 Gordon et al. ..... 53/399
5,369,416 A 11/1994 Haverty et al.
5,414,979 A 5/1995 Moore et al.
5,447,008 A 9/1995 Martin-Cocher
5,450,711 A 9/1995 Martin-Cocher
5,463,842 A 11/1995 Lancaster
5,524,413 A 6/1996 Fukuda
5,546,730 A 8/1996 Newell et al.
5,572,855 A 11/1996 Reigrut et al.
5,581,979 A 12/1996 Scherer
5,595,042 A 1/1997 Cappi et al.
5,634,321 A 6/1997 Martin-Cocher et al.
5,653,093 A 8/1997 Delledonne
5,671,593 A 9/1997 Ginestra et al.
5,765,344 A 6/1998 Mandeville et al.
5,768,862 A 6/1998 Mauro et al.
5,797,246 A 8/1998 Martin-Cocher
5,799,471 A 9/1998 Chen
5,836,140 A 11/1998 Lancaster, III
5,875,617 A 3/1999 Scherer
5,884,453 A 3/1999 Ramsey et al.
5,953,888 A 9/1999 Martin-Cocher et al.
6,082,081 A 7/2000 Mucha
6,185,900 B1 2/2001 Martin
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,338,480 B1 1/2002 Endo
6,360,512 B1 3/2002 Marois et al.
6,370,839 B1 4/2002 Nakagawa et al.
6,453,643 B1 9/2002 Buscherini et al.
6,516,591 B1 2/2003 Lancaster, III et al.
6,684,612 B2 2/2004 Trottet
6,698,161 B1 3/2004 Rossi
6,748,718 B2 6/2004 Lancaster, III et al.
6,826,893 B2 12/2004 Cere'
6,848,240 B2 2/2005 Frey
6,851,252 B2 2/2005 Maki-Rahkola et al.
6,918,229 B2 7/2005 Lancaster, III et al.
7,040,071 B2 5/2006 Heikaus
7,114,308 B2 10/2006 Cox
7,386,968 B2 6/2008 Sperry et al.
7,490,823 B2 2/2009 Oishi et al.
7,540,128 B2 6/2009 Lancaster, III et al.
7,568,327 B2 8/2009 Lancaster, III et al.
7,707,801 B2 5/2010 Lancaster, III
7,707,901 B2 5/2010 Lancaster, III et al.
7,779,607 B2 8/2010 Lancaster, III et al.
8,001,745 B2 * 8/2011 Carter et al. ..... 53/64
8,037,660 B2 10/2011 Lancaster, III et al.
8,074,431 B1 12/2011 Pierson
8,276,346 B2 10/2012 Lancaster, III et al.
8,276,354 B2 10/2012 Lancaster, III et al.
8,739,502 B2 6/2014 Lancaster, III
8,915,460 B2 12/2014 Busch et al.
2001/0015057 A1 8/2001 Suolahti
2003/0089081 A1 5/2003 Platon
2003/0110737 A1 * 6/2003 Lancaster et al. ..... 53/441
2003/0145563 A1 8/2003 Cere'
2003/0200731 A1 10/2003 Maki-Rahkola et al.
2003/0200732 A1 10/2003 Maki-Rahkola et al.
2004/0031238 A1 2/2004 Cox
2004/0040477 A1 3/2004 Neumann
2005/0044812 A1 3/2005 Lancaster et al.
2005/0115202 A1 6/2005 Mertz et al.
2006/0028969 A1 2/2006 Kondo et al.
2006/0213155 A1 9/2006 Forni et al.
2006/0248858 A1 11/2006 Lancaster
2006/0254214 A1 11/2006 Cox et al.
2006/0254225 A1 11/2006 Lancaster et al.
2006/0289691 A1 12/2006 Forni
2007/0204564 A1 9/2007 Lancaster et al.
2007/0204565 A1 9/2007 Lancaster et al.
2007/0209324 A1 9/2007 Lancaster et al.
2008/0216449 A1 9/2008 Zimmerli
2008/0229714 A1 9/2008 Zitella et al.
2008/0295614 A1 12/2008 Lancaster, III et al.
2009/0178374 A1 7/2009 Lancaster, III et al.
2009/0293425 A1 12/2009 Carter et al.
2010/0107653 A1 5/2010 Paskevich et al.
2010/0239403 A1 9/2010 Lancaster, III et al.
2010/0300049 A1 12/2010 Schmidt et al.
2010/0303526 A1 12/2010 Hayase
2010/0320305 A1 12/2010 Lia
2011/0131927 A1 6/2011 Lancaster, III et al.
2011/0146203 A1 6/2011 Lancaster, III et al.
2011/0153277 A1 6/2011 Morath
2011/0168751 A1 7/2011 Tsurumi
2011/0179752 A1 7/2011 Lancaster, III et al.
2012/0031053 A1 2/2012 Lancaster, III et al.
2012/0102887 A1 5/2012 Lancaster, III et al.
2012/0124944 A1 5/2012 Lancaster, III et al.
2012/0181368 A1 7/2012 Ekola
2013/0076753 A1 3/2013 Lancaster, III et al.
2014/0116006 A1 5/2014 Lancaster, III et al.

(56) References Cited

U.S. PATENT DOCUMENTS

| | | | |
|---|---|---|---|
| 2014/0116007 | A1 | 5/2014 | Lancaster, III et al. |
| 2014/0116008 | A1 | 5/2014 | Lancaster, III et al. |
| 2015/0353220 | A1 | 12/2015 | Lancaster, III |
| 2017/0088301 | A1 | 3/2017 | Riemenschneider |

FOREIGN PATENT DOCUMENTS

| | | | |
|---|---|---|---|
| DE | 3634924 | A1 | 4/1988 |
| DE | 3901704 | A1 | 8/1990 |
| DE | 4234604 | A1 | 4/1994 |
| DE | 19509649 | | 9/1996 |
| EP | 0096635 | A2 | 12/1983 |
| EP | 0144266 | A2 | 6/1985 |
| EP | 0246659 | A1 | 11/1987 |
| EP | 0466980 | A1 | 1/1992 |
| EP | 0653352 | A1 | 5/1995 |
| EP | 0671324 | A1 | 9/1995 |
| EP | 0811554 | A1 | 12/1997 |
| EP | 1125841 | A1 | 8/2001 |
| EP | 1213223 | A1 | 6/2002 |
| EP | 1489004 | A2 | 12/2004 |
| EP | 1705119 | A1 | 9/2006 |
| EP | 1717149 | A1 | 11/2006 |
| EP | 1736426 | A2 | 12/2006 |
| EP | 1736426 | A3 | 10/2007 |
| GB | 1 546 523 | A | 5/1979 |
| GB | 2059906 | A | 4/1981 |
| GB | 2107668 | A | 5/1983 |
| JP | 57166252 | | 10/1982 |
| JP | 63191707 | | 8/1988 |
| JP | 0385209 | | 4/1991 |
| JP | 06239311 | | 8/1994 |
| JP | 085448 | | 1/1996 |
| JP | 09254913 | A | 9/1997 |
| JP | 11165705 | A | 6/1999 |
| JP | 2001048111 | | 2/2001 |
| JP | 2001072012 | A | 3/2001 |
| JP | 2002211503 | | 7/2002 |
| JP | 2004161344 | A | 6/2004 |
| JP | 3634993 | | 1/2005 |
| JP | 4350940 | | 10/2009 |
| WO | WO 9107341 | A1 | 5/1991 |
| WO | 9420367 | A1 | 9/1994 |
| WO | 9700202 | A1 | 1/1997 |
| WO | 9822346 | A1 | 5/1998 |
| WO | 2004069659 | A1 | 8/2004 |
| WO | 2006110596 | A1 | 10/2006 |
| WO | 2007071593 | A1 | 6/2007 |
| WO | 2007/100596 | A2 | 9/2007 |
| WO | 2007100597 | A2 | 9/2007 |
| WO | WO 2007100596 | A2 | 9/2007 |
| WO | 2008007189 | A2 | 1/2008 |
| WO | 2008129432 | A1 | 10/2008 |
| WO | WO 2012058549 | A2 | 5/2012 |

OTHER PUBLICATIONS wulftecstretchwrapper.blogspot.com; "The Technology Behind a "No-Tear", "No-Rip" Film Carriage, and How to Explain It to Your Customers"; published Jan. 1, 2010.

European Patent Office; Partial Search Report in International Patent Application No. PCT/US2007/004589 dated Sep. 10, 2007; 7 pages European Patent Office; Search Report in International Patent Application No. PCT/US2004/000219 dated Jun. 21, 2004; 3 pages.

European Patent Office; Search Report in International Patent Application No. PCT/US2007/004588 dated Aug. 27, 2007; 2 pages.

European Patent Office; Search Report in International Patent Application No. PCT/US2007/004581 dated Feb. 5, 2008; 3 pages.

European Patent Office; Search Report and Written Opinion in International Patent Application No. PCT/US2010/028355 dated Jul. 7, 2010; 12 pages.

European Patent Office; Search Report and Written Opininon in International Patent Application No. PCT/US2009/030327 dated Jun. 22, 2009; 16 pages.

European Patent Office; Search Report and Written Opinion in International Patent Application No. PCT/US2006/013178 dated Aug. 14, 2006; 9 pages.

http://2012.modexshow.com/press/release.aspx?ref=press&id=1899. Feb. 6, 2012.

http://www.mhpn.com/product/force_anticipation_stretch_technology_for_stretch_wrappers/packaging. Nov. 23, 2012.

http://www.wulftec.com/contents/brochures/015f519c-8a1a-4a0b-81d1-727cbdcbf946.pdf. Oct. 10, 2010.

http://literature.rockwellautomation.com/idc/groups/literature/documents/ap/oem-ap069_-en-p.pdf. Aug. 1, 2011.

http://www.packworld.com/machinery/pallelizing/wulftec-international-inc-film-feeding-system-secure-product-containment. Sep. 14, 2011.

Bossler, John D., "Manual of Geospatial Science and Technology", CRC Press 2001, pp. 8-15.

* cited by examiner

DEMAND BASED WRAPPING

This application is a continuation-in-part of application Ser. No. 12/349,929, filed Jan. 7, 2009 now U.S. Pat. No. 9,725,195, which claims priority under 35 U.S.C. § 119 of Provisional Application No. 61/006,338, filed Jan. 7, 2008, the disclosures of which are incorporated herein by reference in their entirety. This application claims priority under 35 U.S.C. § 119 of Provisional Application No. 61/258,740, filed Nov. 6, 2009, the disclosure of which is incorporated herein by reference in its entirety.

TECHNICAL FIELD

The present disclosure relates to an apparatus and a method for wrapping a load with packaging material, and more particularly, to dispensing packaging material for wrapping a load based on demand.

BACKGROUND

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Historically, wrappers have suffered from packaging material breaks and limitations on the amount of wrap force applied to the load (as determined in part by the amount of pre-stretch used) due to erratic speed changes required to wrap "non-square" loads, such as narrow, tall loads, short, wide loads, and short, narrow loads. The non-square shape of such loads often results in the supply of excess packaging material during the wrapping cycle, during time periods in which the demand rate for packaging material by the load is exceeded by the supply rate of the packaging material by the packaging material dispenser. This leads to loosely wrapped loads. In addition, when the demand rate for packaging material by the load is greater than the supply rate of the packaging material by the packaging material dispenser, breakage of the packaging material may occur.

When wrapping a typical rectangular load, the demand for packaging material varies, decreasing as the packaging material approaches contact with a corner of the load and increasing after contact with the corner of the load. When wrapping a tall, narrow load or a short load, the variation in the demand rate is even greater than in a typical rectangular load. In vertical rotating rings, high speed rotating arms, and turntable apparatuses, the variation is caused by a difference between the length and the width of the load. In a horizontal rotating ring apparatus, the variation is caused by a difference between the height of the load (distance above the conveyor) and the width of the load. Variations in demand may make it difficult to properly wrap the load. The problem with variations is exacerbated when wrapping a load having one or more dimensions that may differ from one or more corresponding dimensions of a preceding load. The problem may also be exacerbated when wrapping a load having one or more dimensions that vary at one or more locations of the load itself.

The amount of force, or pull, that the packaging material exhibits on the load determines how tightly and securely the load is wrapped. Conventionally, this wrap force is controlled by controlling the feed or supply rate of the packaging material dispensed by the packaging material dispenser. For example, the wrap force of many known commercially available stretch wrapping machines is controlled by attempting to alter the supply of packaging material such that a relatively constant packaging material wrap force is maintained. With powered pre-stretching devices, changes in the force or tension of the dispensed packaging material were monitored. This has been accomplished using feedback mechanisms typically linked to spring loaded dancer bars, electronic load cells, or torque control devices. The changing force or tension of the packaging material caused by rotating a rectangular shaped load is transmitted back through the packaging material to some type of sensing device which attempts to vary the speed of the motor driven dispenser to minimize the change. The passage of the corner causes the force or tension of the packaging material to increase. This increase is typically transmitted back to an electronic load cell, spring-loaded dancer interconnected with a sensing means, or to a torque control device. After the corner is passed, the force or tension of the packaging material reduces. This reduction is transmitted back to some device that in turn reduces the packaging material supply to attempt to maintain a relatively constant wrap force or tension.

With the ever faster wrapping rates demanded by the industry, the rotation speeds have increased significantly to a point where the concept of sensing changes in force and altering supply speed in response loses effectiveness. The delay of response has been observed to begin to move out of phase with rotation at approximately 20 RPM. The actual response time for the rotating mass of packaging material roll and rollers approximating 100 lbs must shift from accelerate to decelerate eight times per revolution that at 20 RPM is a shift more than every one half of a second.

Also significant is the need to minimize the acceleration and deceleration times for these faster cycles. Initial acceleration must pull against clamped packaging material, which typically cannot stand a high force especially the high force of rapid acceleration that cannot be maintained by the feedback mechanisms described above. Use of high speed wrapping has therefore been limited to relatively lower wrap forces and pre-stretch levels where the loss of control at high speeds does not produce undesirable packaging material breaks.

The present disclosure is directed to overcoming one or more of the above-noted problems, as well as other problems in the art.

SUMMARY OF THE DISCLOSURE

According to an aspect of the present disclosure, a control system for a wrapping apparatus may include a packaging material dispenser configured to dispense packaging material for wrapping a load. The control system may also include at least one sensor assembly configured to generate a signal based on instantaneous demand for packaging material at the load. The control system may further include a controller configured to control operation of the packaging material dispenser based at least in part on the signal.

According to another aspect of the present disclosure, an apparatus for wrapping a load may include a packaging material dispenser. The packaging material dispenser may include a dispensing drive configured to drive the packaging material dispenser to dispense packaging material. The apparatus may also include a relative rotation assembly configured to provide relative rotation between the packaging material dispenser and the load. The apparatus may further include a first sensor assembly configured to sense a characteristic indicative of instantaneous demand for packaging material at the load. The apparatus may also include a controller configured to control operation of the dispensing drive based at least in part on the instantaneous demand.

According to yet another aspect of the present disclosure, a method for wrapping a load may include driving a packaging material dispenser to dispense packaging material with a dispensing drive. The method may also include providing relative rotation between the packaging material dispenser and the load. The method may also include sensing a characteristic indicative of instantaneous demand for packaging material at the load. The method may further include controlling operation of the dispensing drive based at least in part on the instantaneous demand.

Additional objects and advantages of the disclosure will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles of the disclosure.

DESCRIPTION OF THE EXEMPLARY EMBODIMENTS

Reference will now be made in detail to present embodiments of the disclosure, examples of which is illustrated in the accompanying drawings. Wherever possible, the same reference numbers will be used throughout the drawings to refer to the same or like parts. The disclosures of each of U.S. Pat. No. 4,418,510, entitled "STRETCH WRAPPING APPARATUS AND PROCESS," and filed Apr. 17, 1981; U.S. Pat. No. 4,953,336, entitled "HIGH TENSILE WRAPPING APPARATUS," and filed Aug. 17, 1989; U.S. Pat. No. 4,503,658, entitled "FEEDBACK CONTROLLED STRETCH WRAPPING APPARATUS AND PROCESS," and filed Mar. 28, 1983; U.S. Pat. No. 4,676,048, entitled "SUPPLY CONTROL ROTATING STRETCH WRAPPING APPARATUS AND PROCESS," and filed May 20, 1986; U.S. Pat. No. 4,514,955, entitled "FEEDBACK CONTROLLED STRETCH WRAPPING APPARATUS AND PROCESS," and filed Apr. 6, 1981; U.S. Pat. No. 6,748,718, entitled "METHOD AND APPARATUS FOR WRAPPING A LOAD," and filed Oct. 31, 2002; U.S. Patent Application Publication No. 2006/0248858, entitled "METHOD AND APPARATUS FOR DISPENSING A PREDETERMINED FIXED AMOUNT OF PRE-STRETCHED FILM RELATIVE TO LOAD GIRTH," filed Apr. 6, 2006; U.S. Patent Application Publication No. 2007/0209324, entitled "METHOD AND APPARATUS FOR SECURING A LOAD TO A PALLET WITH A ROPED FILM WEB," and filed Feb. 23, 2007; U.S. Patent Application Publication No. 2007/0204565, entitled "METHOD AND APPARATUS FOR METERED PRE-STRETCH FILM DELIVERY," and filed Sep. 6, 2007; U.S. Patent Application Publication No. 2007/0204564, entitled "RING WRAPPING APPARATUS INCLUDING METERED PRE-STRETCH FILM DELIVERY ASSEMBLY," and filed Feb. 23, 2007; and U.S. Patent Application Publication No. 2009/0178374, entitled "ELECTRONIC CONTROL OF METERED FILM DISPENSING IN A WRAPPING APPARATUS," and filed Jan. 7, 2009, are incorporated herein by reference in their entirety.

Figure 1:
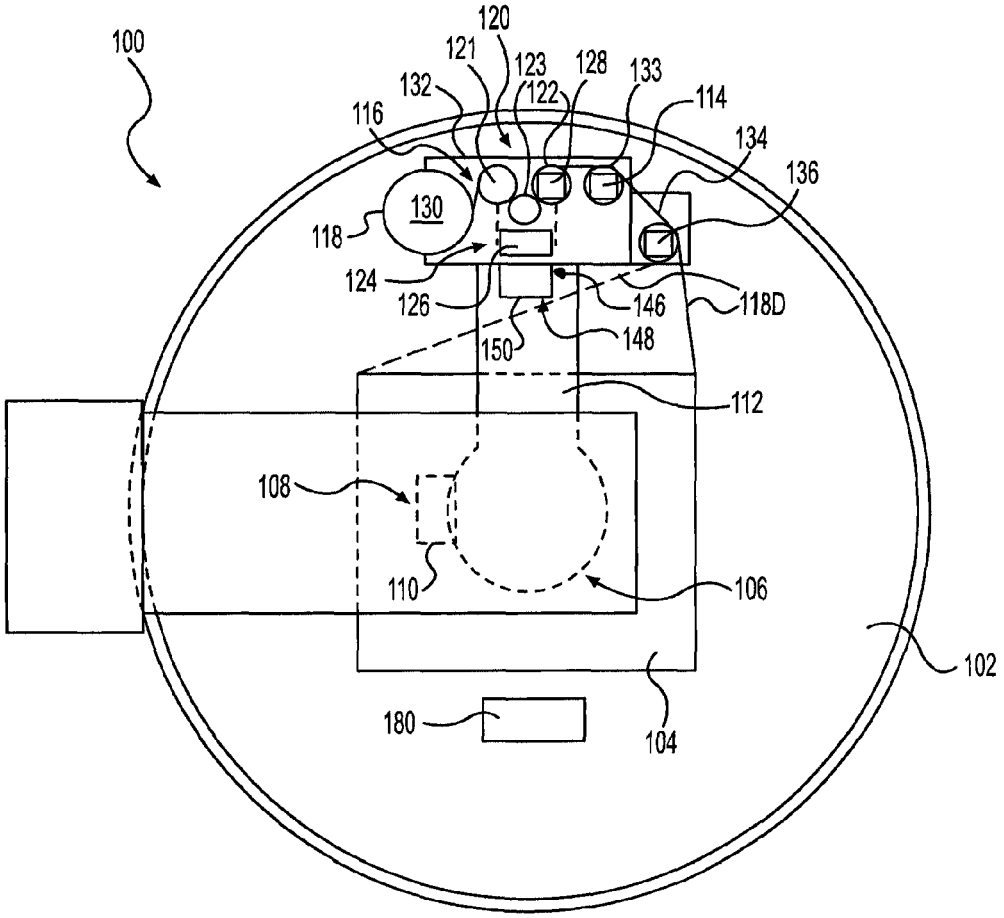
FIG. 1 shows a top view of a first exemplary wrapping apparatus according to one aspect of the present disclosure.

According to one aspect of the present disclosure, a wrapping apparatus 100, shown in FIG. 1, may include a roll carriage 132 mounted on a rotating arm 112. Roll carriage 132 may include a packaging material dispenser 116. Packaging material dispenser 116 may be configured to dispense packaging material 118 as rotating arm 112 rotates relative to a load 104 to be wrapped. In an exemplary embodiment, packaging material dispenser 116 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, or tape.

Packaging material dispenser 116 may include a pre-stretch assembly 120 configured to pre-stretch packaging material before it is applied to load 104 if pre-stretching is desired, or to dispense packaging material to load 104 without pre-stretching. Pre-stretch assembly 120 may include at least one packaging material dispensing roller, including, for example, an upstream dispensing roller 121 and a downstream dispensing roller 122. It is contemplated that pre-stretch assembly 120 may include an assembly of pre-stretch rollers and idle rollers, similar to those described in U.S. Patent Application Publication Nos. 2006/0248858, 2007/0204565, 2007/0204564, and 2009/0178374, the disclosures of which are incorporated herein by reference in their entirety. Additional or fewer rollers may be used as desired.

The terms "upstream" and "downstream," as used in this application, are intended to define positions and movement relative to the direction of flow of packaging material 118 as it moves from packaging material dispenser 116 to load 104. Movement of an object toward packaging material dispenser 116, away from load 104, and thus, against the direction of flow of packaging material 118, may be defined as "upstream." Similarly, movement of an object away from packaging material dispenser 116, toward load 104, and thus, with the flow of packaging material 118, may be defined as "downstream." Also, positions relative to load 104 (or a load support surface 102) and packaging material dispenser 116 may be described relative to the direction of packaging material flow. For example, when two pre-stretch rollers are present, the pre-stretch roller closer to packaging material dispenser 116 may be characterized as the "upstream" roller and the pre-stretch roller closer to load 104 (or load support surface 102) and further from packaging material dispenser 116 may be characterized as the "downstream" roller.

A packaging material drive system 124, including, for example, an electric motor 126, may be used to drive dispensing rollers 121 and 122. For example, electric motor 126 may rotate downstream dispensing roller 122. Downstream dispensing roller 122 may be operatively coupled to upstream dispensing roller 121 by a chain and sprocket assembly, such that upstream dispensing roller 121 may be driven in rotation by downstream dispensing roller 122. Other connections may be used to drive upstream roller 121 or, alternatively, a separate drive (not shown) may be provided to drive upstream roller 121.

Downstream dispensing roller 122, and/or packaging material 118 dispensed thereby, may be monitored for the purposes of determining the rotational speed of downstream dispensing roller 122, the number of rotations undergone by downstream dispensing roller 122, the amount and/or speed of packaging material dispensed by downstream dispensing roller 122, and/or one or more performance parameters indicative of the operating state of packaging material drive system 124, including, for example, a speed of packaging material drive system 124. The monitored characteristics may also provide an indication of the amount of packaging material 118 being dispensed and wrapped onto load 104.

Figure 2:
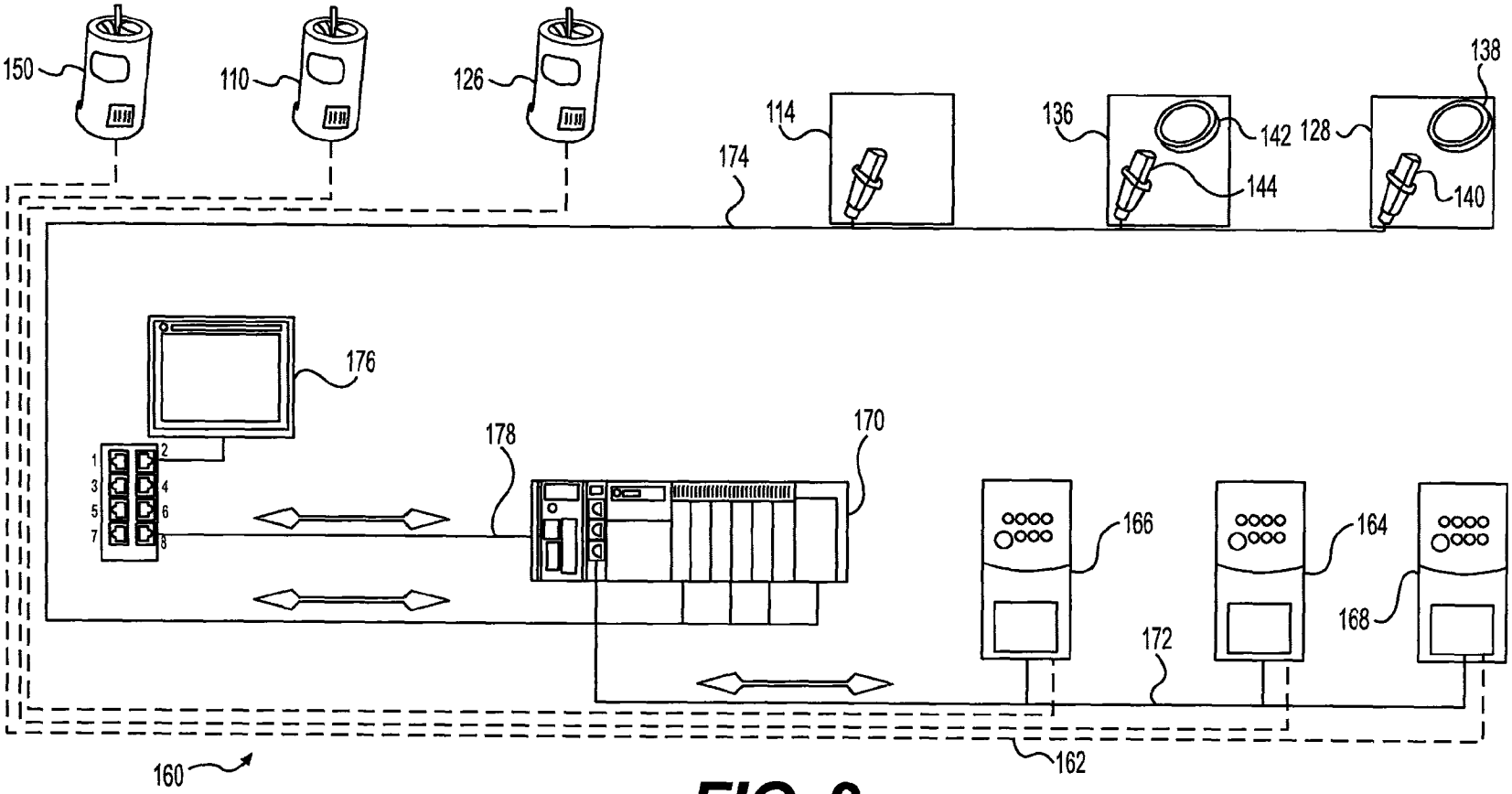
FIG. 2 is a schematic showing an exemplary control system according to one aspect of the present disclosure.

One way of monitoring is via use of a sensor assembly 128. In one embodiment, sensor assembly 128 may be configured to sense rotation of downstream dispensing roller 122. Sensor assembly 128, as shown in FIG. 2, may include one or more magnetic transducers 138 mounted on downstream dispensing roller 122, and a sensing device 140 configured to generate a pulse when the one or more magnetic transducers 138 are brought into proximity of sensing device 140. Alternatively, sensor assembly 128 may include an encoder configured to monitor rotational movement. The encoder may be capable of producing 720 signals per revolution of downstream dispensing roller 122 to provide an indication of the speed or other characteristic of rotation of downstream dispensing roller 122. The encoder may be mounted on a shaft of downstream dispensing roller 122, on electric motor 126, and/or any other suitable area. One example of a sensor assembly that may be used is a Sick 7900266 Magnetic Sensor and Encoder. Other suitable sensors and/or encoders known in the art may be used for monitoring, such as, for example, magnetic encoders, electrical sensors, mechanical sensors, photodetectors, and/or motion sensors. Sensor assembly 128 may generate a drive signal based at least in part on the monitored characteristics.

Instantaneous demand for packaging material 118 at the load 104 may be determined and/or approximated for control purposes, such as for controlling packaging material dispensing. As used herein, the term "demand" may be defined as the quantity of packaging material needed to wrap at least a portion of the load to achieve a desired wrap force and/or containment force. As used herein, wrap force is defined as the force exerted on the load by an individual web of packaging material applied to the load. As used herein, containment force is defined as the force exerted on the load by cumulative layers of packaging material. The containment force may be generated by the wrap forces exerted on the load by multiple layers of packaging material. The term "instantaneous demand" may be defined as the demand for packaging material at a load at a particular instant. There are many ways to determine values indicative of instantaneous demand. The instantaneous demand may be characterized as the speed an unstretchable material (e.g., a wire) would be dispensed from the packaging material dispenser onto the load if the unstretchable material was drawn from the packaging material dispenser by relative rotation between the packaging material dispenser and the load, with a speed of the relative rotation remaining substantially constant.

For a wrapping apparatus with a packaging material dispenser that rotates around a stationary load (e.g., a rotating arm apparatus or a rotating ring apparatus), the instantaneous demand may be represented or approximated by a line extending perpendicularly from the rotational axis of the packaging material dispenser to a plane defined by a surface of a length of the packaging material that extends between the packaging material dispenser and the load. For a wrapping apparatus with a rotating load instead of a rotating packaging material dispenser, such as a rotating turntable apparatus, the instantaneous demand may be represented or approximated by a line extending perpendicularly from the rotational axis of the rotating turntable to the plane. Additionally or alternatively, the instantaneous demand may be represented or approximated by a line extending radially from the rotational axis of the packaging material dispenser to a point on the surface of the load (for a rotating packaging material dispenser), or by a line extending radially from the rotational axis of the rotating turntable to a point on the surface of the load (for a rotating load). Additionally or alternatively, the instantaneous demand may be represented or approximated by a line extending from a point on the packaging material dispenser to a plane defined by a surface of a length of the packaging material that extends between the packaging material dispenser and the load.

Figure 5:
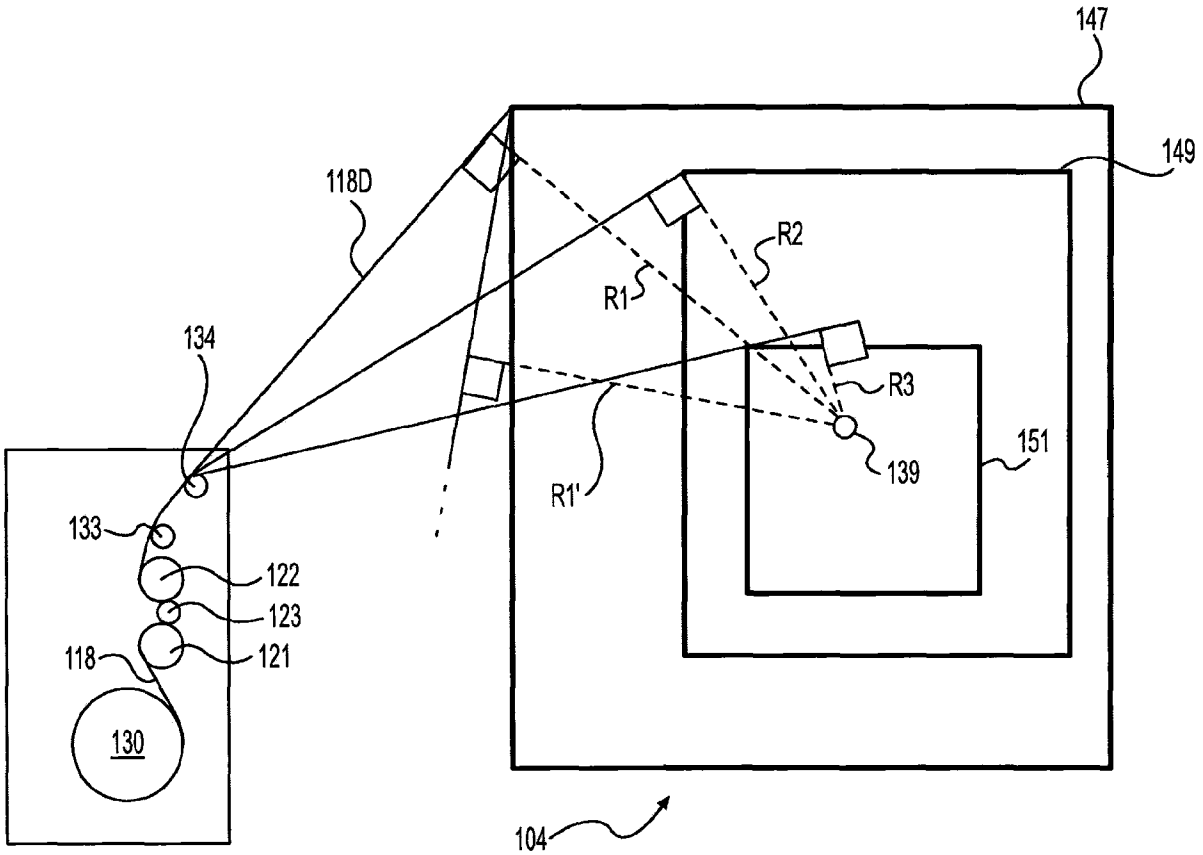
FIG. 5 is a top view of a packaging material dispenser and a load, according to one aspect of the present disclosure.

For example, as shown in FIG. 5, when the packaging material dispenser is in the position shown (relative to the load) while wrapping a bottom portion of the load, the instantaneous demand at that instant may be represented or approximated by R1. When the packaging material dispenser is in the position shown (relative to the load) while wrapping a middle portion of the load, the instantaneous demand at that instant may be represented or approximated by R2. Further, when the packaging material dispenser is in the position shown (relative to the load) while wrapping a top portion of the load 104, the instantaneous demand at that instant may be represented or approximated by R3. Thus, it should be understood that for wrapping a load like the one shown in FIG. 5, the instantaneous demand may change during wrapping as the characteristics of the portion of the load being wrapped change. The varying profile of the load in FIG. 5 may be due to the load being composed of units that have different sizes and/or dimensions, that may be stacked together to form the load.

Figure 7:
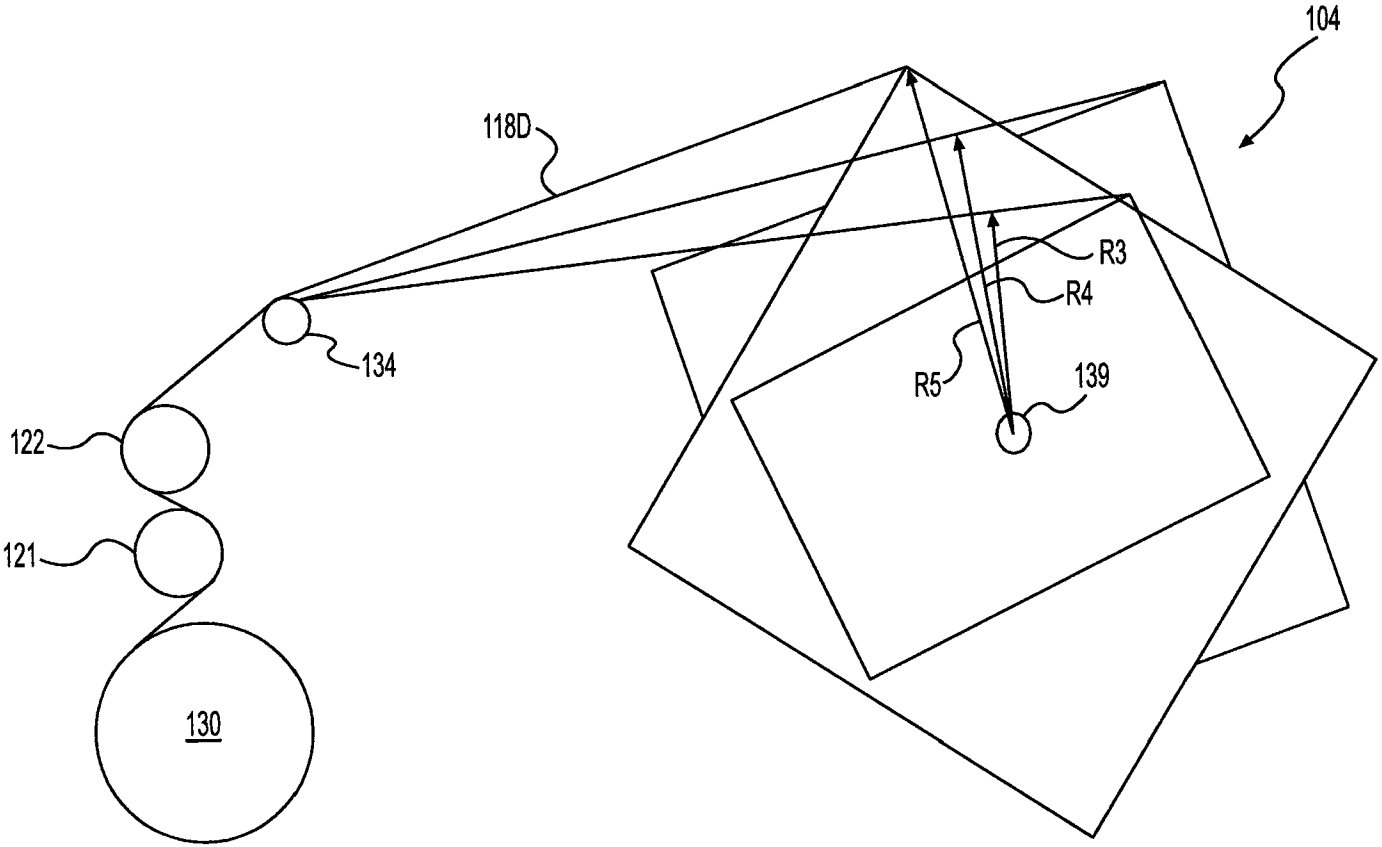
FIG. 7 is a top view of a packaging material dispenser and a load, according to another aspect of the present disclosure.

FIG. 7 shows representations or approximations of instantaneous demand for top, middle, and bottom portions of an irregularly shaped load when the packaging material dispenser is in the position shown (relative to the load). The instantaneous demand while wrapping the top portion may be represented or approximated by R4, the instantaneous demand while wrapping the middle portion may be represented or approximated by R5, and the instantaneous demand while wrapping the bottom portion may be represented or approximated by R6.

Even during portions of the wrapping cycle where the characteristics of the portion of the load being wrapped do not change, the instantaneous demand may change. For example, in FIG. 5, as the packaging material dispenser is wrapping the bottom portion of the load, when the packaging material dispenser is in the position shown (relative to the load), the instantaneous demand may be represented or approximated by R1. If the packaging material dispenser rotates in the counterclockwise direction, then upon reaching an eight o'clock position in FIG. 5, the instantaneous demand may be represented or approximated by a line R1'. R1' is shorter than R1, thus indicating that the instantaneous demand decreased as the packaging material dispenser traveled from the position shown to the eight o'clock position. The instantaneous demand decreased even though the characteristics of the bottom portion of the load did not change. The change in instantaneous demand is due to the shape of the bottom portion of the load. The instantaneous demand will increase when the length of packaging material between packaging material dispenser and the load contacts a corner of the load, and may continue to increase for a period of time thereafter. However, as the length of the packaging material moves toward a face of load, the instantaneous demand will begin to decrease until the next corner is encountered.

Instantaneous demand can also be represented or approximated using a speed of packaging material dispensed by the packaging material dispenser at a location between the packaging material dispenser and the load. Further explanation will be provided in subsequent paragraphs.

Figure 8:
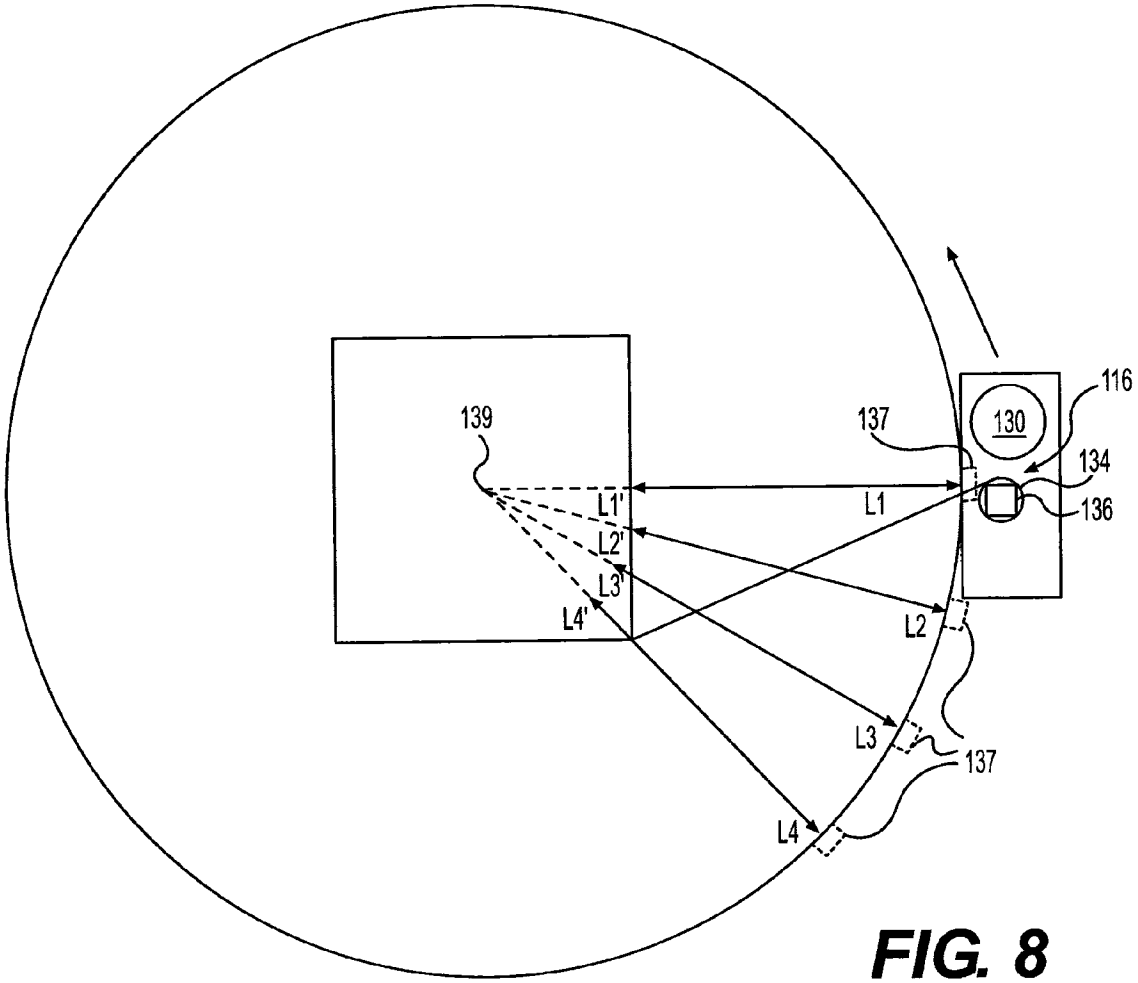
FIG. 8 is a top view of a packaging material dispenser and a load, according to another aspect of the present disclosure.

Instantaneous demand can also be represented or approximated using a distance measurement from a rotational axis of the packaging material dispenser to a point on a surface of the load, taken along a line extending from the rotational axis to a point on, for example, the packaging material dispenser (for a wrapping apparatus where the packaging material dispenser rotates around the load). Additionally or alternatively, the instantaneous demand can be represented or approximated using a distance measurement from a rotational axis of a rotating turntable to a point on a surface of the load, taken along a line extending from the rotational axis to a point on the packaging material dispenser. Such distance measurements are shown in FIG. 8. The measured distance may change during relative rotation between the packaging material dispenser and the load. Further explanation will be provided in subsequent paragraphs.

Figure 9:
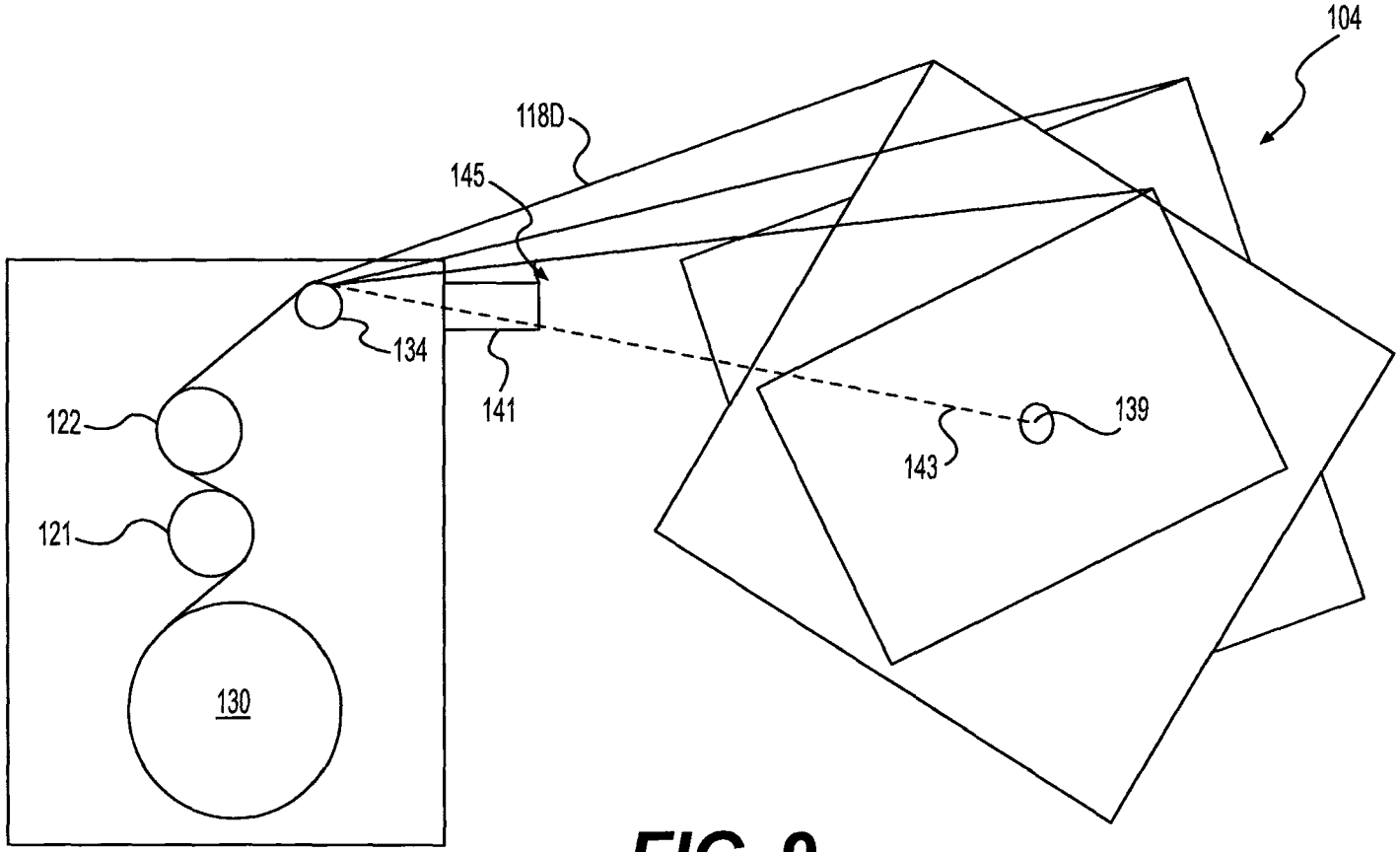
FIG. 9 is a top view of a packaging material dispenser and a load, according to another aspect of the present disclosure.

Instantaneous demand can also be represented or approximated using a distance measurement from a point on, for example, the packaging material dispenser, and a plane defined by a surface of a length of the packaging material that extends between the packaging material dispenser and the load. The measured distance is indicative of an angle between a reference line extending from the point to a point on a surface of a dispensing roller of the packaging material dispenser at which packaging material leaves the dispensing roller, and the plane defined by the surface of the length of the packaging material extending between the packaging material dispenser and the load. Such a distance measurement is shown in FIG. 9. Further explanation will be provided in subsequent paragraphs.

As described above, the instantaneous demand maps characteristics of the load, including, for example, the shape of the load, one or more dimensions of the load, and/or a position of the load relative to the packaging material dispenser. That is, as one or more characteristics changes, the instantaneous demand changes accordingly. Thus, by monitoring the instantaneous demand (e.g., taking periodic or continuous measurements), characteristics of the load can be modeled.

By controlling the packaging material drive system based at least in part on the instantaneous demand, adjustments can be made in response to the variations described above. Thus, loads may be properly wrapped in a consistent manner even though different portions of the load being wrapped have different features or characteristics, or one load to be wrapped has features or characteristics that differ from those of another load to be wrapped. By controlling wrapping of the load as the instantaneous demand changes it may be possible to obtain more consistently wrapped loads, reduce costs by decreasing the likelihood of packaging material breaks and ensuring that excess packaging material is not dispensed, wrap a wide variety of loads regardless of their characteristics, and improve throughput by allowing adjustments to settings to be made automatically.

Three exemplary ways of determining and/or approximating the instantaneous demand for control purposes will now be described. A first way that the instantaneous demand may be determined and/or approximated is by monitoring one or more characteristics of dispensed packaging material 118D extending between load 104 and downstream dispensing roller 122. As shown in FIG. 1, dispensed packaging material 118D can have either of two orientations, one shown in solid black line (where packaging material dispenser 116 rotates in a counterclockwise direction) and the other shown in dashed black line (where packaging material dispenser 116 rotates in a clockwise direction). The one or more characteristics of dispensed packaging material 118D may be monitored using a sensor assembly 136 shown in FIG. 1. As dispensed packaging material 118D moves from downstream dispensing roller 122 to load 104, sensor assembly 136 may be configured to sense, for example, a speed of rotation of an idle roller 134 engaging dispensed packaging material 118D, a speed of dispensed packaging material 118D, and/or an amount of dispensed packaging material 118D. Changes in the monitored characteristics may map changes in the instantaneous demand for packaging material 118 at load 104, and may stem from changes in the size, shape, and/or placement of load 104 relative to packaging material dispenser 116. Thus, as the size, shape, and/or placement of load 104 changes, the instantaneous demand may change in response, and as the instantaneous demand changes, one or more of the characteristics of dispensed packaging material 118D monitored by sensor assembly 136 may change in response.

As one example, sensor assembly 136 may be configured to monitor the rotation of idle roller 134, positioned downstream from dispensing roller 122 and configured to engage dispensed packaging material 118D. This monitoring may be for purposes of sensing the rotational speed of idle roller 134. Sensor assembly 136 may include components similar to those in sensor assembly 128. One example of a sensor assembly that may be used is a Sick 7900266 Magnetic Sensor and Encoder. Other suitable sensors and/or encoders known in the art may be used for monitoring, such as, for example, magnetic encoders, electrical sensors, mechanical sensors, photodetectors, and/or motion sensors. The instantaneous demand and the monitored characteristics of dispensed packaging material 118D may be linked. For example, an increase in the instantaneous demand may produce an increase in the speed of dispensed packaging material 118D, the amount of dispensed packaging material 118D, and/or the speed of rotation of idle roller 134, while a decrease in the instantaneous demand may produce a decrease in the speed of dispensed packaging material 118D, the amount of dispensed packaging material 118D, and/or the speed of rotation of idle roller 134. One reason for this is that as the instantaneous demand increases, load 104 tends to draw packaging material 118 more quickly over idle roller 134, and when instantaneous demand decreases, load 104 tends to draw packaging material 118 more slowly over idle roller 134. Thus, sensor assembly 136, by monitoring the speed of rotation of idle roller 134 during wrapping, monitors the instantaneous demand for packaging material 118 at the portion of load 104 being wrapped. Accordingly, the signal generated by sensor assembly 136, based on monitoring the speed of rotation of idle roller 134, is indicative of instantaneous demand at the portion of load 104 being wrapped. As the instantaneous demand increases (producing an increase in the speed of rotation of idle roller 134), the instantaneous demand signal from sensor assembly 136 may increase. As the instantaneous demand decreases (producing a decrease in the speed of rotation of idle roller 134), the instantaneous demand signal from upstream sensor assembly 136 may decrease.

Additionally or alternatively, one or more characteristics of dispensed packaging material 118D may be monitored with another sensor assembly, similar to sensor assembly 136, but positioned to engage a different portion of dispensed packaging material 118D. This other sensor assembly may include, for example, a sensor assembly 114 configured to monitor an idle roller 133. Idle roller 133 may be similar to idle roller 134. Sensor assembly 114 may also generate an instantaneous demand signal based on the one or more sensed characteristics.

A second way that the instantaneous demand may be determined and/or approximated, in addition to or as an alternative to the first way, is by using a distance measuring device 137 (see FIG. 8), including, for example, a photoeye, proximity detector, laser distance measurer, ultrasonic distance measurer, electronic rangefinder, and/or any other suitable distance measuring device, to provide an signal indicative of instantaneous demand. Exemplary distance measuring devices may include, for example, an IFM Effector 01D100 and a Sick UM30-213118 (6036923).

As shown in FIG. 8, distance measuring device 137 may be placed on or near packaging material dispenser 116. For example, distance measuring device 137 may be mounted on roll carriage 132 which supports, and therefore moves vertically and in rotation with, packaging material dispenser 116. Distance measuring device 137 measures a distance between itself and a surface point on load 104, along a line extending radially from a center of rotation 139 of packaging material dispenser 116. The measured distance may be subtracted from a known distance between the distance measuring device 137 and the center of rotation 139 to find a radial distance between the center of rotation 139 and the surface point on load 104. The calculated distance may provide an indication of instantaneous demand.

In FIG. 8, line L1 represents the distance measured by distance measuring device 137 when packaging material dispenser 116 and load 104 are in the position shown. Line L1' in FIG. 8 represents the radial distance found by subtracting the measured distance L1 from the known distance between the distance measuring device 137 and the center of rotation 139. As relative movement takes place between the packaging material dispenser 116 and the load 104, packaging material dispenser 116 may occupy positions where the lines L2, L3, and L4 represent the distance measured by distance measuring device 137, in which case lines L2', L3', and L4', respectively, represent the radial distances found by subtracting the measured distances from the known distance between the distance measuring device 137 and the center of rotation 139. It is also contemplated that distance measuring device 137 may be selectively movable on a track or other adjustable mounting such that distance measuring device 137 may occupy positions corresponding to those shown at lines L2, L3, and L4 while packaging material dispenser 116 is in the position shown in FIG. 8.

Signals generated by distance measuring device 137 may provide data on the measured distances and/or the calculated radial distances. These signals may provide an indication or approximation of instantaneous demand at the surface point on load 104 where the measurement is taken. As the instantaneous demand increases (exemplified by an increase in the radial distance between the center of rotation 139 and the surface point on load 104), the instantaneous demand signal from distance measuring device 137 may increase. As the instantaneous demand decreases (exemplified by a decrease in the radial distance between the center of rotation 139 and the surface point on load 104), the instantaneous demand signal from distance measuring device 137 may decrease. The signals from distance measuring device 137 may be sent to controller 170 together with signals indicative of relative rotation speed, allowing controller 170 to adjust wrap settings.

Distance measuring device 137 may be positioned on or near packaging material dispenser 116 such that distance measuring device 137 may be used to anticipate changes in the instantaneous demand. For example, distance measuring device 137 may be positioned at a location on or near a forward end of packaging material dispenser 116. This may allow distance measuring device 137 to measure the distance to a portion of load 104 that is not yet being wrapped. By determining the instantaneous demand at that portion of load 104, controller 170 may anticipate the instantaneous demand at that portion. This may provide controller 170 with additional time to adjust operational settings based on the anticipated instantaneous demand. For example, controller 170 may gradually adjust operational settings over a period of time to prevent spikes in force on packaging material 118, and/or to ensure smoother running of packaging material dispenser 116. It should be understood that a calculated delay may be required to align packaging material dispensing with the instantaneous demand determined and/or approximated using distance measuring device 137.

A third way that the instantaneous demand may be determined and/or approximated, in addition to or as an alternative to the first and second ways, is by using a distance measuring device 141 (see FIG. 9), including, for example, a photoeye, proximity detector, laser distance measurer, ultrasonic distance measurer, electronic rangefinder, and/or any other suitable distance measuring device, to provide a signal indicative of instantaneous demand. Exemplary distance measuring devices may include, for example, an IFM Effector 01D100 and a Sick UM30-213118 (6036923).

As shown in FIG. 9, distance measuring device 141 may be placed on or near packaging material dispenser 116. For example, distance measuring device 141 may be mounted on roll carriage 132. Distance measuring device 137 measures a distance between itself and a point on a surface of dispensed packaging material 118D. The measured distance, identified with reference numeral 145 in FIG. 9, corresponds to an angle between a reference line 143 (extending from a tangent point on idle roller 134 and center of rotation 139) and a plane defined by the surface of dispensed packaging material 118D. The measured distance and/or the angle provide an indication or approximation of the instantaneous demand for packaging material 118 at the portion of load 104 being wrapped.

Signals generated by distance measuring device 141 may provide data on the measured distances and/or angles. Thus, these signals may be indicative of instantaneous demand at the surface point on load 104 being wrapped. As the instantaneous demand increases (exemplified by an increase in the measured distance or angle), the instantaneous demand signal from distance measuring device 141 may increase. As the instantaneous demand decreases (exemplified by a decrease in the measured distance or angle), the instantaneous demand signal from distance measuring device 141 may decrease. The signals from distance measuring device 141 may be sent to controller 170 together with signals indicative of relative rotation speed, allowing controller 170 to adjust wrap settings.

By controlling the relationship between the operation of packaging material drive 124 and the instantaneous demand, as determined and/or approximated using one or more of the ways described above, apparatus 100 may wrap at least a portion of load 104 at a desired and/or predetermined payout percentage even as conditions change. The word "predetermined," as used herein, means "determined and set in advance." Values described herein as "predetermined" may include values determined through, for example, experimentation, analysis of historical performance data, use of mathematical equations and formulas, measurement, and/or any other suitable ways of making determinations, that are set in advance (e.g., before starting a wrapping cycle or during a wrapping cycle as conditions change) to achieve a desired goal. As used herein, the phrase "payout percentage" is defined as a ratio of the amount of packaging material dispensed for at least a portion of a wrapping cycle to the demand for packaging material at the load for that same portion of the wrapping cycle.

The desired and/or predetermined payout percentage may be input into apparatus 100 by a machine operator. A controller 170 (shown in FIG. 2), or any other suitable computing device, may determine, based on the payout percentage, and signals from sensing assembly 136, distance measuring device 137, and/or distance measuring device 141 (which provide indications or approximations of instantaneous demand), the length of packaging material 118 that should be dispensed for a period of time or portion of a relative revolution between packaging material dispenser 116 and load 104. For example, if the operator enters a payout percentage of 110%, and the instantaneous demand is 111 inches for a period of time, then the output from packaging material dispenser 116 for that period of time may be approximately 121 inches of packaging material 118. If the operator enters a payout percentage of 100%, then the output from packaging material dispenser 116 for the same instantaneous demand of 111 inches would be approximately 111 inches of packaging material 118.

Wrapping apparatus 100 may include a relative rotation assembly 106 configured to rotate rotating arm 112, and thus, packaging material dispenser 116 mounted thereon, relative to load 104 as load 104 is supported on load support surface 102. Relative rotation assembly 106 may include a rotational drive system 108, including, for example, an electric motor 110. It is contemplated that rotational drive system 108 and packaging material drive system 124 may run independently of one another. Thus, rotation of dispensing rollers 121 and 122 may be independent of the relative rotation of packaging material dispenser 116 relative to load 104. This independence allows a length of packaging material 118 to be dispensed per a portion of relative revolution that is neither predetermined or constant. Rather, the length may be adjusted periodically or continuously based on changing conditions.

Wrapping apparatus 100 may further include a lift assembly 146. Lift assembly 146 may be powered by a lift drive system 148, including, for example, an electric motor 150, that may be configured to move roll carriage 132 vertically relative to load 104. Lift drive system 148 may drive roll carriage 132, and thus packaging material dispenser 116, upwards and downwards vertically on rotating arm 112 while roll carriage and packaging material dispenser 116 are rotated about load 104 by rotational drive system 108, to wrap packaging material spirally about load 104.

An exemplary schematic of a control system 160 for wrapping apparatus 100 is shown in FIG. 2. Rotational drive system 108, packaging material drive system 124, and lift drive system 148 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement. For example, packaging material drive VFD 166 may provide controller 170 with signals similar to signals provided by sensing assembly 128, and thus, sensing assembly 128 may be omitted to cut down on manufacturing costs.

Controller 170 may include hardware components and software programs that allow it to receive, process, and transmit data. It is contemplated that controller 170 may operate similar to a processor in a computer system. Controller 170 may communicate with an operator interface 176 via a data link 178. Operator interface 176 may include a screen and controls that may provide an operator with a way to monitor, program, and operate wrapping apparatus 100. For example, an operator may use operator interface 176 to enter or change predetermined and/or desired settings and values, or to start, stop, or pause the wrapping cycle. Controller 170 may also communicate with one or more sensor assemblies (described above) through a data link 174, thus allowing controller 170 to receive performance related data during wrapping. It is contemplated that data links 162, 172, 174, and 178 may include any suitable wired communications medium known in the art. It is also contemplated that data links 162, 172, 174, and 178 may include any suitable wireless communications medium known in the art that allows the sensor assemblies to transmit data wirelessly to controller 170.

By controlling the operation of packaging material drive 124 based at least in part on the instantaneous demand with controller 170, apparatus 100 may wrap at least a portion of load 104 at the predetermined and/or desired payout percentage for at least a portion of a wrapping cycle. The portion of the wrapping cycle may be a portion of a single relative revolution between the dispenser and the load, a complete relative revolution, or more than a single relative revolution. During that portion of the wrapping cycle, load 104 may be wrapped with a substantially equal wrap force around its perimeter. This may be achieved even though the instantaneous demand may change during the portion of the wrapping cycle. Such changes in instantaneous demand may be caused by, for example, a change in one or more dimensions of the load, the shape of the portion of the load being wrapped, the placement of the load being wrapped relative to packaging material dispenser 116, and/or the speed of relative rotation of packaging material dispenser 116 relative to load 104.

The instantaneous demand, as well as changes in the instantaneous demand may be determined and/or approximated by or using sensor assembly 136, distance measuring device 137, and/or distance measuring device 141. Controller 170 may receive signals from sensor assembly 136, distance measuring device 137, and/or distance measuring device 141. Along with the signals from distance measuring device 137 and/or distance measuring device 141, controller 170 may also receive a relative rotation speed signal from any suitable sensor (not shown) monitoring rotational drive system 108. Controller 170 may also receive the drive signal from sensor assembly 128, as it monitors dispensing roller 122. Controller 170 may be programmed to set or adjust operation of packaging material drive system 124 by changing the frequency of electrical power supplied to packaging material drive VFD 166, based on the instantaneous demand signal. Additionally, controller 170 may be programmed to set or adjust operation of packaging material drive system 124 based at least in part on the relative rotation speed signal when the instantaneous demand signal is from distance measuring device 137 of distance measuring device 141.

For example, controller 170 may be programmed to use the instantaneous demand signal from sensor assembly 136, distance measuring device 137, and/or distance measuring device 141 as a baseline signal, and may adjust operation of packaging material drive system 124 as the instantaneous demand signal changes. If the instantaneous demand signal increases, controller 170 may adjust operation of packaging material drive system 124 to produce a corresponding increase in the drive signal. If the instantaneous demand signal decreases, controller 170 may adjust operation of packaging material drive system 124 to produce a corresponding decrease in the drive signal. Controller 170 may adjust operation of packaging material drive system 124 until the drive signal is equal to the instantaneous demand signal (producing a payout percentage of 100% and/or equal rotation speeds for dispensing roller 122 and idle roller 134), and/or within a predetermined and/or desired range above the instantaneous demand signal (producing a payout percentage of more than 100% and/or a rotation speed for dispensing roller 122 that exceeds the rotation speed of idle roller 134) or below the instantaneous demand signal (producing a payout percentage of less than 100% and/or a rotation speed for dispensing roller 122 that is exceeded by the rotation speed of idle roller 134). The adjusted drive signal may be linked with the speed of downstream dispensing roller 122 required to produce the desired payout percentage in light of the instantaneous demand.

A plot of drive signal values and instantaneous demand signal values over time may produce a drive signal curve and an instantaneous demand signal curve that are similar. For example, the drive signal curve and the instantaneous demand signal curve may be sinusoidal (due, for example, to the presence of sides and corners on rectangular loads), and may be coincident, vertically offset (i.e., parallel) by a predetermined and/or desired magnitude, and/or horizontally offset by a predetermined and/or desired magnitude. By performing these steps, controller 170 may produce the predetermined and/or desired payout percentage for the portion of the wrapping cycle. Of course, when the instantaneous demand signal remains substantially constant, controller 170 may operate packaging material drive system 124 in a substantially constant manner.

It is also contemplated that controller 170 may be programmed to use the instantaneous demand signal from sensor assembly 114 as the baseline signal, if sensor assembly 114 is provided. It is further contemplated that sensor assembly 128 may be ignored or omitted, and controller 170 may be programmed to adjust operation of packaging material drive system 124 as the instantaneous demand signal changes, without monitoring downstream drive roller 122. In such an embodiment, controller 170 may increase the speed of packaging material drive system 124 when the instantaneous demand signal increases, and decrease the speed of packaging material drive system 124 when the instantaneous demand signal decreases. The change in the speed of packaging material drive system 124 may be proportional to the magnitude of the change in the instantaneous demand signal. Moreover, the speed of packaging material drive system 124 may be set at a first level relative to the instantaneous demand signal to achieve a first payout percentage, at a higher level to achieve a higher payout percentage, and at a lower level to achieve a lower payout percentage. A plot of the speed of packaging material drive system 124 and instantaneous demand signal values over time may produce a drive speed curve and an instantaneous demand signal curve that are similar (e.g., sinusoidal, coincident, vertically offset, and/or horizontally offset).

Figure 6:
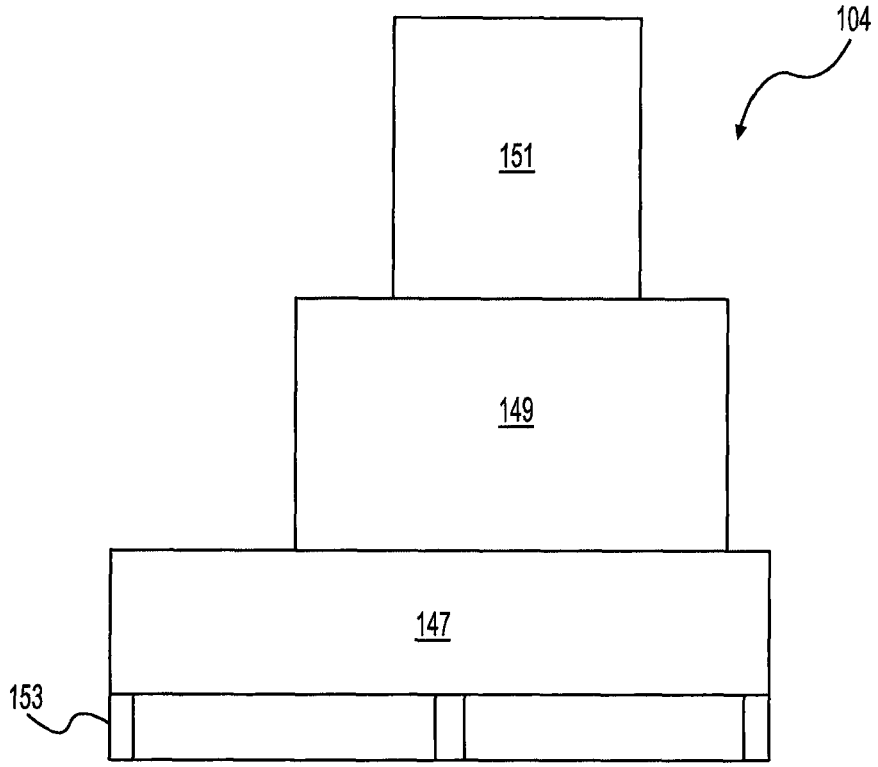
FIG. 6 is a side view of the load of FIG. 5, according to the present disclosure.

By using the instantaneous demand signal as a baseline, controller 170 may make adjustments when wrapping loads with varying profiles, including, for example, loads composed of units having different dimensions; when wrapping loads with irregular shapes, including, for example, non-square loads; or when wrapping square loads that are positioned off-center of load support surface 102. When wrapping such loads, it is possible for the instantaneous demand to change a plurality of times. For example, when packaging material dispenser 116 moves from wrapping a top portion 151 to a middle portion 149 of load 104 (see, e.g., FIGS. 5 and 6), or middle portion 149 to a bottom portion 147, or when packaging material dispenser 116 wraps a corner of load 104 after having wrapped a flat surface of load 104, the increase in the instantaneous demand will produce an increase in the instantaneous demand signal generated by sensor assembly 136. As another example, when packaging material dispenser 116 moves from wrapping bottom portion 147 to middle portion 149, or middle portion 149 to top portion 151, or when packaging material dispenser 116 wraps a flat surface of load 104 after having wrapped a corner of load 104, the decrease in the instantaneous demand will produce a decrease in the instantaneous demand signal generated by sensor assembly 136. Controller 170 may adjust packaging material drive system 124 to compensate for such variations in the manner described above. Thus, wrapping may continue uninterrupted in spite of the variations, since input from an operator is not required in order to compensate for the variations.

It is also contemplated that if, after load 104 is wrapped, a subsequent load to be wrapped has one or more dimensions and/or a shape that is different from that of load 104, the predetermined and/or desired payout percentage may still be produced during wrapping of the subsequent load. For example, if the subsequent load is larger than load 104, there will be a greater instantaneous demand for packaging material 118 at the subsequent load. The increase in instantaneous demand will result in an increase in the instantaneous demand signal, and an increase in the speed of downstream dispensing roller 122 in response. Thus, the predetermined and/or desired payout percentage may be achieved as the speed of downstream dispensing roller 122 rises to meet the increase in the instantaneous demand. If, on the other hand, the subsequent load is smaller than load 104, there will be a smaller instantaneous demand for packaging material 118 at the subsequent load. The decrease in instantaneous demand will result in a decrease in the instantaneous demand signal, and a decrease in the speed of downstream dispensing roller 122. Thus, once again, the predetermined and/or desired payout percentage may be achieved as the speed of downstream dispensing roller 122 falls to meet the decrease in the instantaneous demand. As such, wrapping at the predetermined and/or desired payout percentage may be accomplished although the actual dimensions of the load being wrapped are unknown, and/or a series of loads to be wrapped have random shapes and/or dimensions.

A buffer may be added to dampen or reduce the amplitude of the speed variation undergone by downstream dispensing roller 122. By doing so, the buffer may allow smoother operation to be achieved during wrapping. The buffer may also reduce stress on packaging material 118, helping to prevent packaging material breaks from occurring.

The buffer may operate by dampening or delaying the instantaneous demand signal from sensing assembly 136 in instances where the instantaneous demand is trending down or decreasing. Dampening and/or delaying the instantaneous demand signal may weaken, reduce, and/or slow the response of controller 170 to the decrease in instantaneous demand. While this could result in loose wrapping for a portion of the wrapping cycle, such loose wrapping may be remedied by subsequent wrapped layers of packaging material 118. Moreover, the dampening or delaying may help prevent packaging material breaks. When packaging material 118 is torn or otherwise damaged, that portion of packaging material 118 may cause idle roller 134 to slow as it passes over idle roller 134. If controller 170 immediately reacts to the slowing of idle roller 134, as if it was indicative of a decrease in instantaneous demand, controller 170 will increase stress on the damaged portion and potentially cause a packaging material break. By dampening or delaying the instantaneous demand signal, additional time is provided for the damaged portion to be wrapped onto load 104, allowing wrapping to continue. Thus, the benefits obtained by reducing or slowing the response of controller 170 may outweigh any potential drawbacks.

Dampening and/or delaying the instantaneous demand signal from sensing assembly 136, while desirable when the instantaneous demand decreases, may be undesirable when the instantaneous demand increases. For example, when wrapping a corner of load 104 or an enlarged portion of load 104, the instantaneous demand may increase, producing an increase in the instantaneous demand signal. If the instantaneous demand signal is dampened and/or delayed, controller 170 may not be able to adjust packaging material drive system 124 quickly enough to ensure that enough packaging material 118 is dispensed to meet the increased demand. Tension in dispensed packaging material 118D may increase to a point where a tear, or even a break, may develop. Thus, when the instantaneous demand signal increases, any dampening and/or delaying of the instantaneous demand signal may be avoided.

Controller 170 may also be programmed to detect packaging material breaks during at least a portion of the wrapping cycle. As used herein, the term "break" is meant to describe a complete or total severing of packaging material 118, that is, a cutting or tearing across the entire width of packaging material 118 that splits the packaging material 118 into separate pieces. The term "break" is not meant to refer to a relatively small puncture, rip, or tear in packaging material 118 that may be carried through onto load 104 during wrapping. However, if the relatively small puncture, rip, or tear in packaging material 118 stretches to the point that it completely severs packaging material 118 before making its way onto load 104, then the relatively small puncture, rip, or tear will have become a break. The direction of rotation of idle roller 134 may reverse due to recovery of the packaging material after breakage or backlash of the broken packaging material. Thus, controller 170 may recognize that a packaging material break has occurred when a reversal is sensed. When a packaging material break is detected, controller 170 may instruct packaging material drive VFD 166 to stop packaging material drive system 124, thus halting the dispensing of packaging material 118 from packaging material dispenser 116. It is also contemplated that packaging material breaks may be detected using photodetectors, loads cells, spring-biased rollers, and/or any other suitable devices known in the art.

Controller 170 may also be programmed to give priority to some signals from sensing assembly 136, distance measuring device 137, and/or distance measuring device 141, over other signals. For example, rather than treating all of the signals as equally important, the controller 170 may give the signals corresponding to the corners of load 104 (such as those represented by R3, R4, and R5 in FIG. 7; L4' in FIG. 8; and any of the lines representing dispensed packaging material 118D in FIG. 9) higher priority. Signals corresponding to the corners may be sensed by controller 170 due to the presence of peak values (e.g., packaging material speed, radial distance, and packaging material path angle) at the corners. Each corner may be treated as an effective girth of load 104, such that the instantaneous demand recognized by controller 170 for all parts of load 104, including the substantially flat faces between the corners of load 104, is the instantaneous demand for the corner being sensed by the controller 170. When a subsequent corner is sensed by controller 170, the instantaneous demand recognized by controller 170 for all parts of load 104 is the instantaneous demand for that corner. This process takes place as each corner is sensed, and eliminates or reduces fluctuations associated with adjusting dispensing to meet the needs of corners and faces of the load 104. Reducing or eliminating fluctuations by focusing on the corners and downplaying or ignoring the flat surfaces of load 104 may provide smoother machine operation.

Figure 3:
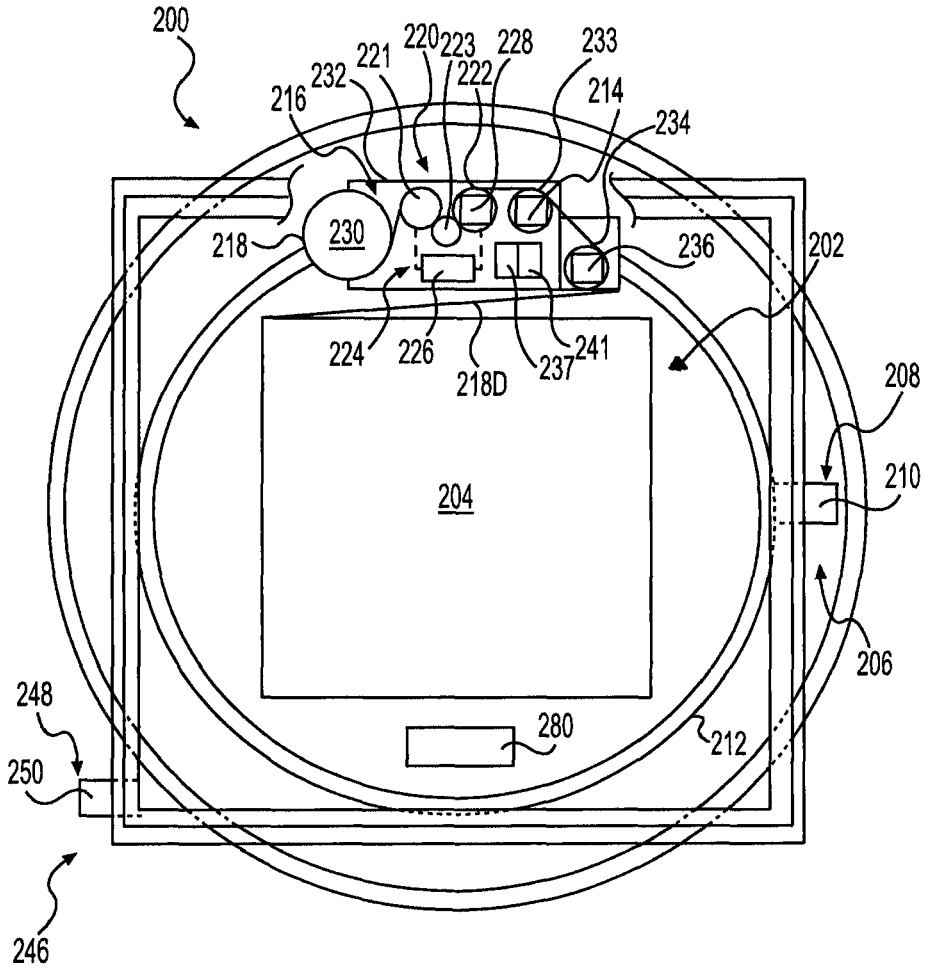
FIG. 3 shows a top view of a second exemplary wrapping apparatus according to another aspect of the present disclosure.

FIG. 3 shows a wrapping apparatus 200 of the rotating ring variety. Wrapping apparatus 200 may include elements similar to those shown in relation to wrapping apparatus 200. While each and every element in FIG. 3 is not described in detail, it should be understood that elements in FIG. 3 that are similar to elements in FIG. 1 are represented with similar reference numerals. As shown, wrapping apparatus 200 includes a rotating ring 212 in place of rotating arm 112 of wrapping apparatus 100. However, it should be understood that wrapping apparatus 200 may operate in a manner similar to that described above with respect to wrapping apparatus 100.

Wrapping apparatus 200 may include an idle roller 234 and a sensing assembly 236 similar to idle roller 134 and sensing assembly 136. Sensing assembly 236, like sensing assembly 136, may provide a signal indicative of instantaneous demand. Additionally or alternatively, a distance measuring sensor 237, similar to distance measuring sensor 137, may be mounted on or near any point on packaging material dispenser 216, roll carriage 232, rotating ring 212, and/or any other suitable location where distance measuring sensor 237 can measure the distance to load 204 while rotating relative to load 204. It is contemplated that distance measuring sensor 237 may be mounted such that its view is not obstructed by dispensed packaging material 218D. Additionally or alternatively, a distance measuring sensor 241, similar to distance measuring sensor 141, may be mounted on or near any point on packaging material dispenser 216, roll carriage 232, rotating ring 212, and/or any other suitable location where distance measuring sensor 241 can measure the distance to dispensed packaging material 218D while load 204 is wrapped.

Wrapping apparatus 200 may also include a controller (not shown) similar to controller 170. The controller may receive signals from sensor assembly 236, distance measuring device 237, and/or distance measuring device 241. The controller may also receive a drive signal from a sensor assembly 228 (similar to sensor assembly 128), as it monitors a dispensing roller 222 (similar to dispensing roller 122). The controller may be programmed to set or adjust operation of a packaging material drive system 224 (similar to packaging material drive system 124) by, for example, changing the frequency of electrical power supplied to a packaging material drive (not shown, but similar to packaging material drive VFD 166) based on the instantaneous demand signals from sensing assembly 236, distance measuring device 237, and/or distance measuring device 241.

Figure 4:
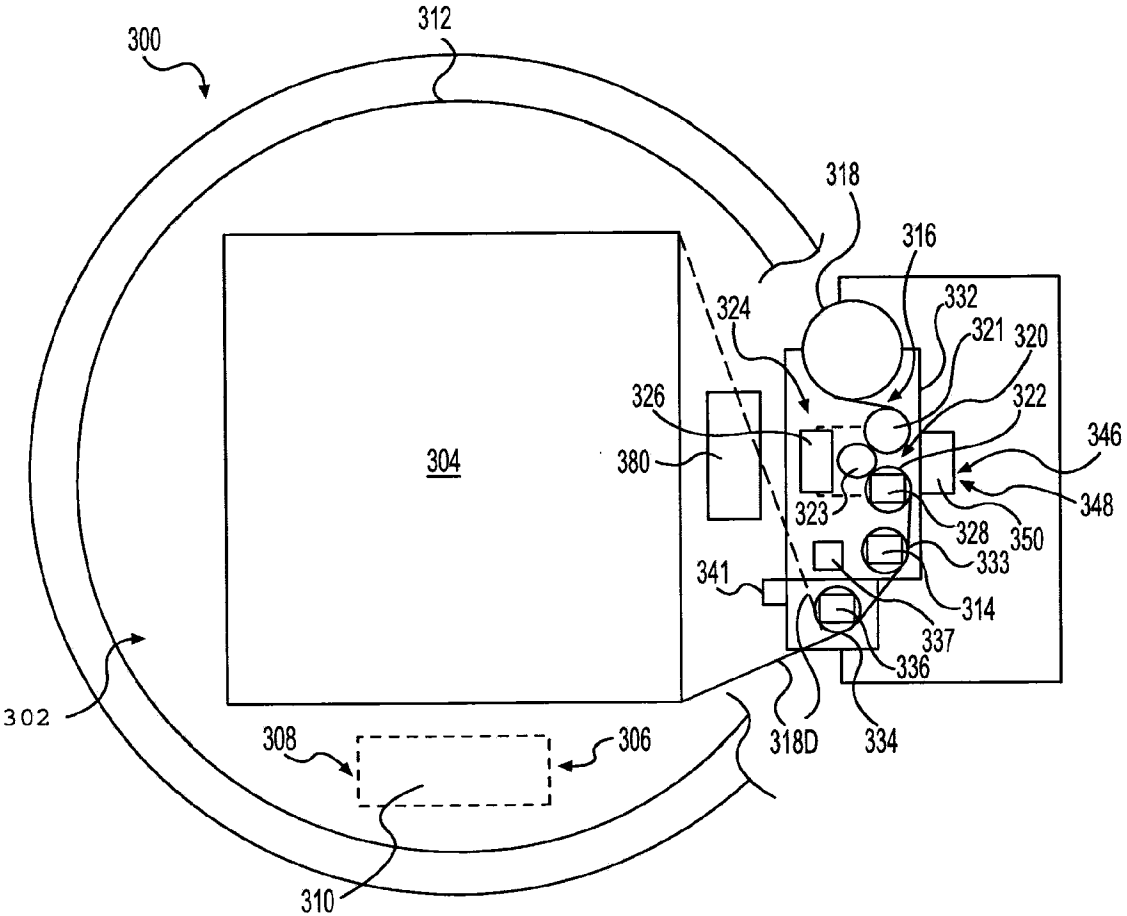
FIG. 4 shows a top view of a third exemplary wrapping apparatus according to yet another aspect of the present disclosure.

FIG. 4 shows a wrapping apparatus 300 of the rotating turntable variety. Wrapping apparatus 300 may include elements similar to those shown in relation to wrapping apparatus 100. While each and every element in FIG. 4 is not described in detail, it should be understood that elements in FIG. 4 that are similar to elements in FIG. 1 are represented with similar reference numerals. As shown, wrapping apparatus 300 includes a rotating turntable 312 for rotating load 304 while packaging material dispenser 316 remains fixed, in place of rotating arm 112 of wrapping apparatus 100. However, it should be understood that wrapping apparatus 300 may operate in a manner similar to that described above with respect to wrapping apparatus 100.

Wrapping apparatus 300 may include an idle roller 334 and a sensing assembly 336 similar to idle roller 134 and sensing assembly 136. Sensing assembly 336, like sensing assembly 136, may provide a signal indicative of instantaneous demand. Additionally or alternatively, a distance measuring sensor 337, similar to distance measuring sensor 137, may be mounted on or near any point on packaging material dispenser 316, roll carriage 332, and/or any other suitable location where distance measuring sensor 337 can measure the distance to load 304 while rotating relative to load 304. It is contemplated that distance measuring sensor 337 may be mounted such that its view is not obstructed by dispensed packaging material 318D. Additionally or alternatively, a distance measuring sensor 341, similar to distance measuring sensor 141, may be mounted on or near any point on packaging material dispenser 316, roll carriage 332, and/or any other suitable location where distance measuring sensor 341 can measure the distance to dispensed packaging material 318D while load 304 is wrapped.

Wrapping apparatus 300 may also include a controller (not shown) similar to controller 170. The controller may receive signals from sensor assembly 336, distance measuring device 337, and/or distance measuring device 341. The controller may also receive a drive signal from a sensor assembly 328 (similar to sensor assembly 128), as it monitors a dispensing roller 322 (similar to dispensing roller 122). The controller may be programmed to set or adjust operation of a packaging material drive system 324 (similar to packaging material drive system 124) by, for example, changing the frequency of electrical power supplied to a packaging material drive (not shown, but similar to packaging material drive VFD 166) based on the instantaneous demand signals from sensing assembly 336, distance measuring device 337, and/or distance measuring device 341.

While pre-stretched packaging material is included in the exemplary embodiments described above, it should be understood that other types of packaging material, such as those that do not undergo pre-stretching (e.g., netting, strapping, banding, or tape), may also be used. Such an embodiment would be similar to the embodiment including pre-stretched packaging material, except that the speed of rotation of the upstream dispensing roller, which may be indicative of the speed and/or amount of undispensed packaging material coming off the upstream dispensing roller, may be substantially equal to the speed of rotation of the downstream dispensing roller, which may be indicative of the speed and/or amount of dispensed packaging material coming off the downstream dispensing roller.

A first exemplary method for wrapping a load will now be described. Reference will be made to elements in FIGS. 1 and 2. Initially, packaging material dispenser 116 may be in its home position, that is, proximate clamping device 180 shown in FIG. 1. Packaging material 118 may extend from packaging material dispenser 116 toward clamping device 180. Clamping device 180 may grip a leading end of packaging material 118. Load 104 may be placed on wrapping surface 102. Load 104 may be placed on wrapping surface 102 by a pallet truck (not shown), may be conveyed onto wrapping surface 102 using a conveying means (i.e., rollers or a conveying belt; not shown), or may be built on wrapping surface 102 by stacking or arranging a number of items thereon.

The predetermined and/or desired payout percentage may be obtained by or entered into controller 170. The predetermined and/or desired payout percentage may be selected, for example, based on the desired wrap force. The desired wrap force may be obtained by, for example, looking at historical performance data to identify a wrap force that has successfully prevented shifting of loads similar to load 104 during shipping.

With load 104 in place, and controller 170 programmed with the predetermined and/or desired payout percentage, controller 170 may begin wrapping load 104. Controller 170 may implement operational settings of wrapping apparatus 100 so that a sufficient amount of packaging material 118 is dispensed initially to prevent pulling the initial end of packaging material 118 out of or off of clamping device 180, and so that load 104 may be properly wrapped. For example, controller 170 may implement settings to produce the predetermined and/or desired payout percentage.

During wrapping, the instantaneous demand for packaging material 118 at load 104 may change due to changes in load girth within load 104, features associated with the shape of load 104 (e.g., flat surfaces and/or corners), one or more dimensions of load 104, and/or placement of load 104 relative to packaging material dispenser 116 (e.g., on or off center with respect to the rotational axis of packaging material dispenser 116). If the instantaneous demand increases, producing an increase in the instantaneous demand signal from sensor assembly 136, distance measuring device 137, and/or distance measuring device 141, controller 170 may increase the speed of dispensing roller 122 in response to maintain the predetermined and/or desired payout percentage. When the instantaneous demand signal is supplied by distance measuring device 137 or distance measuring device 141, controller 170 may also obtain a relative rotation speed signal for determining the speed of dispensing roller 122 in response to maintain the predetermined and/or desired payout percentage. If the instantaneous demand at load 104 decreases, producing a decrease in the instantaneous demand signal, controller 170 may decrease the speed of dispensing roller 122 in response to maintain the predetermined and/or desired payout percentage. For example, the instantaneous demand at load 104 may decrease as packaging material dispenser 116 moves from wrapping middle portion 149 of load 104 to wrapping top portion 151 of load 104, since top portion 151 has a smaller girth than middle portion 149. This decrease in the portion of load 104 being wrapped may correspond to a decrease in the instantaneous demand that is sensed by sensor assembly 136, resulting in a decrease in the instantaneous demand signal to controller 170, which decreases the speed of dispensing roller 122 in response to maintain the predetermined and/or desired payout percentage.

Controller 170 may implement a buffer to ensure that it responds to decreases in the instantaneous demand signal, as indicated by sensing assembly 136, less severely and/or less quickly than it responds to increases in the instantaneous demand signal. The buffer may dampen and/or delay the instantaneous demand signal from sensing assembly 136 when the instantaneous demand signal decreases. Dampening may reduce fluctuations, thus providing for smoother machine operations. Dampening may also allow damaged portions (e.g., portions with a hole and/or a partial tear) of packaging material 118 to pass onto load 104 without causing complete failure of packaging material 118.

Packaging material dispenser 116 may dispense packaging material 118 to form one or more layers around a bottom portion of load 104, a top portion of a pallet 153 supporting load 104, the sides of load 104, and a top portion of load 104. With load 104 substantially wrapped, packaging material dispenser 116 may proceed back towards its home position proximate clamping device 180 in FIG. 1. With packaging material dispenser 116 in its home position, the wrapping cycle ends. Newly wrapped load 104 may be conveyed or otherwise removed from wrapping surface 102 to make room for a subsequent load. Since the instantaneous demand is determined and/or approximated during wrapping of a load, the subsequent load may have a different size, shape, and/or placement as compared to the preceding load, and yet the subsequent load can be wrapped at the desired payout percentage.

During wrapping, controller 170 may also monitor the rotation of an idle roller, such as idle roller 134, using downstream sensor assembly 136, to detect when a break has occurred in packaging material 118. Controller 170 may determine that a break has occurred if a decrease in the sensed instantaneous demand is of a magnitude, and/or occurs within a period of time, indicative of a break having occurred. Additionally or alternatively, if sensor assembly 136 senses that at least idle roller 134 has undergone a reversal in rotation, controller 170 may recognize that a break has occurred. If a break is detected, controller 170 may instruct packaging material drive VFD 166 to stop packaging material drive system 124, thus halting the dispensing of packaging material 118 from packaging material dispenser 116. It should be understood that idle roller 133 and sensor assembly 114 may be used in place of, or in combination with, idle roller 134 and sensor assembly 136, in the steps described above.

In a second exemplary method for wrapping a load, packaging material dispenser 116 may be in its home position proximate clamping device 180, packaging material 118 may extend from packaging material dispenser 116 toward clamping device 180, and clamping device 180 may grip the leading end of packaging material 118. Load 104 may be placed on wrapping surface 102 in a manner similar to that described in the first method. The predetermined and/or desired payout percentage may be obtained by or entered into controller 170, after having been selected in a manner similar to that described in the first method. With load 104 in place, and controller 170 programmed with the predetermined and/or desired payout percentage, controller 170 may begin wrapping load 104.

During wrapping, controller 170 may make adjustments to the operational settings of wrapping apparatus 100 so that load 104 may be properly wrapped. For example, controller 170 may implement settings to produce the predetermined and/or desired payout percentage. Controller 170 may retain the instantaneous demand signals from sensor assembly 136, distance measuring device 137, and/or distance measuring device 141, in a memory location for one or more relative revolutions between packaging material dispenser 116 and load 122. For example, controller 170 may generate a curve indicative of instantaneous demand versus time for the one or more relative revolutions, and/or a curve indicative of instantaneous demand versus time for corners of load 104. The curves may be used by controller 170 as a model of the size and/or shape of load 104. Controller 170 may use the curve as a baseline, and may set and adjust operation of packaging material drive system 124 and its dispensing roller 122 based on the curve, to wrap load 104 at the predetermined and/or desired payout percentage.

After load 104 has been modeled during the one or more relative revolutions, controller 170 may wrap load 104 without referring back to sensor assembly 136, distance measuring device 137, and/or distance measuring device 141, for additional data. Additionally or alternatively, controller 170 may replace the curve with an updated curve if the instantaneous demand signals from sensor assembly 136 are outside of a predetermined range with respect to the curve. The one or more relative revolutions during which controller 170 may model load 104 may include the first relative revolution between packaging material dispenser 116 and load 104 during the start-up period of the wrapping cycle. Additionally or alternatively, the one or more relative revolutions may include the first relative revolution between packaging material dispenser 116 and load 104 during the intermediate period of the wrapping cycle. It is contemplated, however, that the one or more revolutions may include any of the one or more relative revolutions between packaging material dispenser 116 and load 104 during the wrapping cycle.

During wrapping, controller 170 may also monitor the rotation of idle roller 134, using downstream sensor assembly 136, to detect when a break has occurred in packaging material 118, in a manner similar to that which was described in the first method. Controller 170 may also include a buffer to dampen and/or delay the instantaneous demand signal when the instantaneous demand signal decreases. With load 104 substantially wrapped, packaging material dispenser 116 may proceed back towards its home position. Similar steps may be performed during wrapping with wrapping apparatuses 200 and 300, where similar elements have similar reference numerals and perform similar operations.

In a third exemplary method for wrapping a load, any of the methods or steps described in U.S. Patent Application Publication No. 2009/0178374, which is incorporated herein by reference in its entirety, may be performed during the wrapping of one or more loads.

It is also contemplated that any sequence or combination of the above-described methods may be performed during the wrapping of one or more loads. For example, while wrapping a load, one method may be performed, whereas while wrapping another load, another method may be performed. Additionally or alternatively, while wrapping a single load, two or more of the three methods may be performed. One method may be performed during one portion of the wrapping cycle, and another method may be performed during another portion of the wrapping cycle. Additionally or alternatively, one load may be wrapped using a first combination of methods, while another load may be wrapped using a second combination of methods (e.g., a different combination of methods, and/or a different sequence of methods).

Each of the elements and methods described in the present disclosure may be used in any suitable combination with the other described elements and methods.

Other embodiments will be apparent to those skilled in the art from consideration of the specification and practice of the present disclosure. It is intended that the specification and examples be considered as exemplary only, with a true scope and spirit of the disclosure being indicated by the following claims.

What is claimed is:

1. A control system for a wrapping apparatus, comprising:

a packaging material dispenser configured to dispense packaging material for wrapping a load supported on a pallet;

at least one sensor assembly including a distance measuring device measuring:

a distance from a first point to a second point within the wrapping apparatus, at least one of the points being on a portion of the dispensed packaging material the sensor assembly generating an input based on the distance;

a controller configured to proportion payout of packaging material from the packaging material dispenser based at least in part on the input;

wherein the measured distance represents an angle measured between a reference line extending from a point on the packaging material dispenser to a point on a surface of a dispensing roller of the packaging material dispenser at which packaging material leaves the dispensing roller, and a plane defined by a surface of the dispensed packaging material extending between the packaging material dispenser and the load.

2. The control system of claim 1, wherein the controller is configured to dampen the input in response to a reduction in the speed of the dispensed packaging material.

3. The control system of claim 1, wherein the first point is on the distance measuring device and the second point is on a surface of the dispensed packaging material.

4. The control system of claim 1, wherein the controller monitors movement of a path of the dispensed packaging material relative to the distance measuring device as the dispensed packaging material is dispensed to the load.

5. The control system of claim 1, wherein the distance measuring device is positioned above the load.

6. The control system of claim 1, wherein the distance measuring device is configured to move with the packaging material dispenser.

7. The control system of claim 1, further including a sensor assembly configured to monitor relative rotation speed between the packaging material dispenser and the load.

8. The method of claim 1, wherein the controller proportions payout of packaging material based at least in part on the input to approximate instantaneous demand for packaging material at the load.

9. An apparatus for wrapping a load supported on a pallet, comprising:

a packaging material dispenser including a dispensing drive configured to drive the packaging material dispenser to dispense packaging material;

a relative rotation assembly configured to provide relative rotation between the packaging material dispenser and the load;

a first sensor assembly including a distance measuring device to measure:

a distance from a first point to a second point within the wrapping apparatus, at least one of the points being on a portion of the dispensed packaging material the first sensor assembly generating an input based on the distance;

a controller configured to control operation of the dispensing drive to dispense packaging material in proportion to the input; and, wherein the distance represents an angle measured between a reference line extending from a point on the packaging material dispenser to a point on a surface of a dispensing roller of the packaging material dispenser at which packaging material leaves the dispensing roller, and a plane defined by a surface of the dispensed packaging material extending between the packaging material dispenser and the load.

10. The apparatus of claim 9, wherein the packaging material dispenser includes a pre-stretch assembly including one or more pre-stretch rollers.

11. The apparatus of claim 9, wherein the sensed characteristic is of movement of the dispensed packaging material at a point between the packaging material dispenser and the load.

12. The apparatus of claim 11, wherein the first sensor assembly is configured to monitor an amount of packaging material dispensed.

13. The apparatus of claim 11, wherein the first sensor assembly is configured to monitor relative movement of a path of the dispensed packaging material relative to the packaging material dispenser.

14. The apparatus of claim 9, further including a second sensor assembly operatively coupled to a dispensing roller of the packaging material dispenser, the second sensor assembly being configured to sense rotation of the dispensing roller.

15. The apparatus of claim 14, wherein the controller is configured to set operation of the dispensing drive such that a signal generated by the second sensor assembly is proportional to a signal generated by the first sensor assembly, during at least a portion of a wrapping cycle.

16. The apparatus of claim 9, wherein the controller is configured to vary operation of the dispensing drive as the signal generated by the first sensor assembly changes.

17. The method of claim 9, wherein the controller proportions payout of packaging material based at least in part on the input to approximate instantaneous demand for packaging material at the load.

18. The apparatus of claim 17, wherein the controller is configured to control operation of the dispensing drive such that a predetermined ratio between an amount of packaging material dispensed and the instantaneous demand is achieved for at least a portion of the relative rotation.

19. A method for wrapping a load supported on a pallet, comprising:

driving a packaging material dispenser to dispense packaging material with a dispensing drive;

providing relative rotation between the packaging material dispenser and the load;

measuring a distance from a first point to a second point within the wrapping apparatus, at least one of the points being on a portion of the dispensed packaging material;

generating an input based on the measured distance;

controlling operation of the dispensing drive to dispense packaging material in proportion to the input; and, wherein the measured distance represents an angle measured between a reference line extending from a point on the packaging material dispenser to a point on a surface of a dispensing roller of the packaging material dispenser at which packaging material leaves the dispensing roller, and a plane defined by a surface of the dispensed packaging material extending between the packaging material dispenser and the load.

20. The method of claim 19, wherein controlling operation of the dispensing drive to dispense packaging material in proportion to the input includes, with a controller, proportioning payout of packaging material based at least in part on the input to approximate instantaneous demand for packaging material at the load.

21. The method of claim 20, wherein controlling operation of the dispensing drive includes producing a predetermined ratio between an amount of packaging material dispensed and the instantaneous demand.

22. The method of claim 19, wherein driving a packaging material dispenser includes driving a dispensing roller of the packaging material dispenser with the dispensing drive.

23. The method of claim 19, further including sensing rotation of the dispensing roller with a dispensing roller sensor assembly, and generating a dispensing roller signal with the dispensing roller sensor assembly based on the sensed rotation of the dispensing roller.

24. The method of claim 19, wherein sensing a distance includes measuring a distance between a distance measuring device and a point on a surface of the dispensed packaging material.

25. The method of claim 20, wherein controlling operation of the dispensing drive includes increasing a speed of the dispensing drive when the instantaneous demand increases and decreasing a speed of the dispensing drive when the instantaneous demand decreases.

* * * * *